US007758042B2

(12) United States Patent
Tomura et al.

(10) Patent No.: US 7,758,042 B2
(45) Date of Patent: Jul. 20, 2010

(54) SHEET FEEDING APPARATUS AND IMAGE FORMING APPARATUS

(75) Inventors: Hisayuki Tomura, Izunokuni (JP); Kei Sawanaka, Susono (JP); Akio Nemoto, Susono (JP); Kazushi Nishikata, Odawara (JP); Masato Suzuki, Mishima (JP); Atsuya Takahashi, Mishima (JP); Shotaro Yoshimura, Mishima (JP); Mitsunari Ito, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 11/623,816

(22) Filed: Jan. 17, 2007

(65) Prior Publication Data

US 2007/0182088 A1 Aug. 9, 2007

(30) Foreign Application Priority Data

Feb. 3, 2006 (JP) ..... 2006-027792

(51) Int. Cl.
*B65H 1/00* (2006.01)

(52) U.S. Cl. ..... 271/162; 271/147; 271/157; 271/164

(58) Field of Classification Search ..... 271/167, 271/164, 145, 157; 221/6
See application file for complete search history.

(56) References Cited

U.S. PATENT DOCUMENTS 4,319,742 A 3/1982 Ulseth
5,228,673 A * 7/1993 Osonoe ..... 271/10.01
5,236,348 A * 8/1993 Fetherolf et al. ..... 400/703
5,662,320 A * 9/1997 Fujiwara et al. ..... 271/3.14
6,869,071 B2 * 3/2005 Amamoto et al. ..... 271/145
2005/0191065 A1 9/2005 Sawanaka et al. ..... 399/16
2007/0145666 A1 6/2007 Nishikata et al. ..... 271/18

FOREIGN PATENT DOCUMENTS

JP 61-049746 3/1986
JP 04159945 A 6/1992
JP 4-243742 8/1992

* cited by examiner

*Primary Examiner*—Patrick Mackey
*Assistant Examiner*—Ernesto Suarez
(74) *Attorney, Agent, or Firm*—Fitzpatrick, Cella, Harper & Scinto

(57) ABSTRACT

Sheets fed out from a sheet feeding portion, which is brought into pressure contact with the sheets by the upward movement of a sheet stacking portion to feed out the sheets, are separated and conveyed one by one while being upwardly curved. During the sheet feeding operation, the sheet stacking portion is sequentially moved up, and when the sheet feeding operation is completed, the sheet stacking portion is moved down. Further, a remaining amount indicating member moved with the upward movement of the sheet stacking portion to indicate the remaining amount of sheets is held at a position before the sheet stacking portion is moved down, by a holding mechanism, when the sheet feeding operation is completed and the sheet stacking portion is moved down.

12 Claims, 21 Drawing Sheets

SHEET FEEDING APPARATUS AND IMAGE FORMING APPARATUS

BACKGROUND OF THE INVENTION

1. Field of the Invention

The invention relates to a construction for indicating the remaining amount of sheets contained in a sheet containing portion provided in an image forming apparatus.

2. Description of the Related Art

In an image forming apparatus of an electrophotographic printing type or an electrostatic recording type such as a conventional copying machine, a laser beam printer (LBP) or a facsimile apparatus, provision is made of a sheet feeding apparatus for feeding sheets stacked in a sheet containing portion to an image forming portion.

As such a sheet feeding apparatus, there is known one provided with a feed roller which is sheet feeding means for feeding out sheets from a sheet feeding cassette which is a sheet containing portion, and a sheet separating member urged against the surface of the feed roller to prevent the double feeding of sheets to be fed.

Now, when for example, images are to be formed on a great deal of sheets at a time, if the remaining amount of sheets contained in a sheet feeding cassette is unknown, there is liable to occur an inconvenient state such as the state that the timing for supplying sheets cannot be known and the work is interrupted in the course of the job.

So, in order to prevent the occurrence of such an inconvenience, there is an apparatus in which for example, a sensor as remaining amount detecting means is disposed in a sheet feeding cassette, and the remaining amount of sheets is adapted to be indicated on the control panel of the image forming apparatus based on information from this sensor. However, in a case where as described above, the remaining amount of sheets is detected by the use of a sensor, the construction of remaining amount detecting means becomes complicated and this leads to an increased cost and therefore, there has been required a sheet remaining amount indicating mechanism of a simple construction.

So, as disclosed in Japanese Patent Application Laid-open No. H04-243742, there is an apparatus which is pivotally provided in a sheet feeding cassette and in which a pointer is mounted on a sheet stacking plate on which sheets are stacked and an indication scale for indicating the remaining amount of sheets is provided on the main body of the sheet feeding cassette. Design is made such that the pointer moves based on the movement of the sheet stacking plate, and the remaining amount of sheets is indicated by the position of the pointer relative to the indication scale (see, for example, Japanese Utility Model Application Laid-open No. S61-49746 and Japanese Patent Application Laid-open No. H04-243742). A user can see the sheet feeding cassette from the outside thereof to confirm the remaining amount of sheets in the sheet feeding cassette, and suitably effect the supplementation or the like of sheets.

Now, in a sheet feeding apparatus and an image forming apparatus, there is a case where if the sheet stacking plate is lifted, the leading edge of the uppermost one of the sheets stacked thereon remains nipped in the nip portion between separating means such as a separating pad or a separating roller and a feed roller. In such case, there is the problem that if the apparatus is left in that state for a long time, a fold will occur to the leading edge of the sheet to cause a faulty image or the jam of the sheet.

So, there has been proposed a construction in which when the feeding of sheets is completed, the sheet stacking plate is lowered and the stacked sheets and the feed roller are separated from each other.

However, in a case where as described above, the sheet stacking plate is lowered, a remaining amount indicating pointer mounted on the sheet stacking plate also moves. Accordingly, there has been the problem that in the case of sheet remaining amount indicating means designed to indicate the remaining amount of sheets by the position of the pointer based on the movement of the sheet stacking plate, the remaining amount of sheets cannot be accurately indicated when the sheet feeding operation is not performed.

SUMMARY OF THE INVENTION

So, the present invention has been made in view of such present situation and has as its object to provide an apparatus, which can reliably indicate the remaining amount of sheets.

The present invention provides a sheet feeding apparatus comprising a sheet containing portion having a sheet stacking portion movable up and down with sheets stacked thereon; a sheet feeding portion brought into pressure contact with the stacked sheets by the upward movement of the sheet stacking portion to feed out the sheets; a lifting and lowering mechanism configured to lift and lower the sheet stacking portion; a movable remaining amount indicating member configured to indicate the remaining amount of sheets according to the position of the sheet stacking portion; and a holding mechanism configured to holding the remaining amount indicating member at a position before the sheet stacking portion is lowered, when the sheet stacking portion is to be lowered.

DESCRIPTION OF THE EXEMPLARY EMBODIMENT

Figure 1:
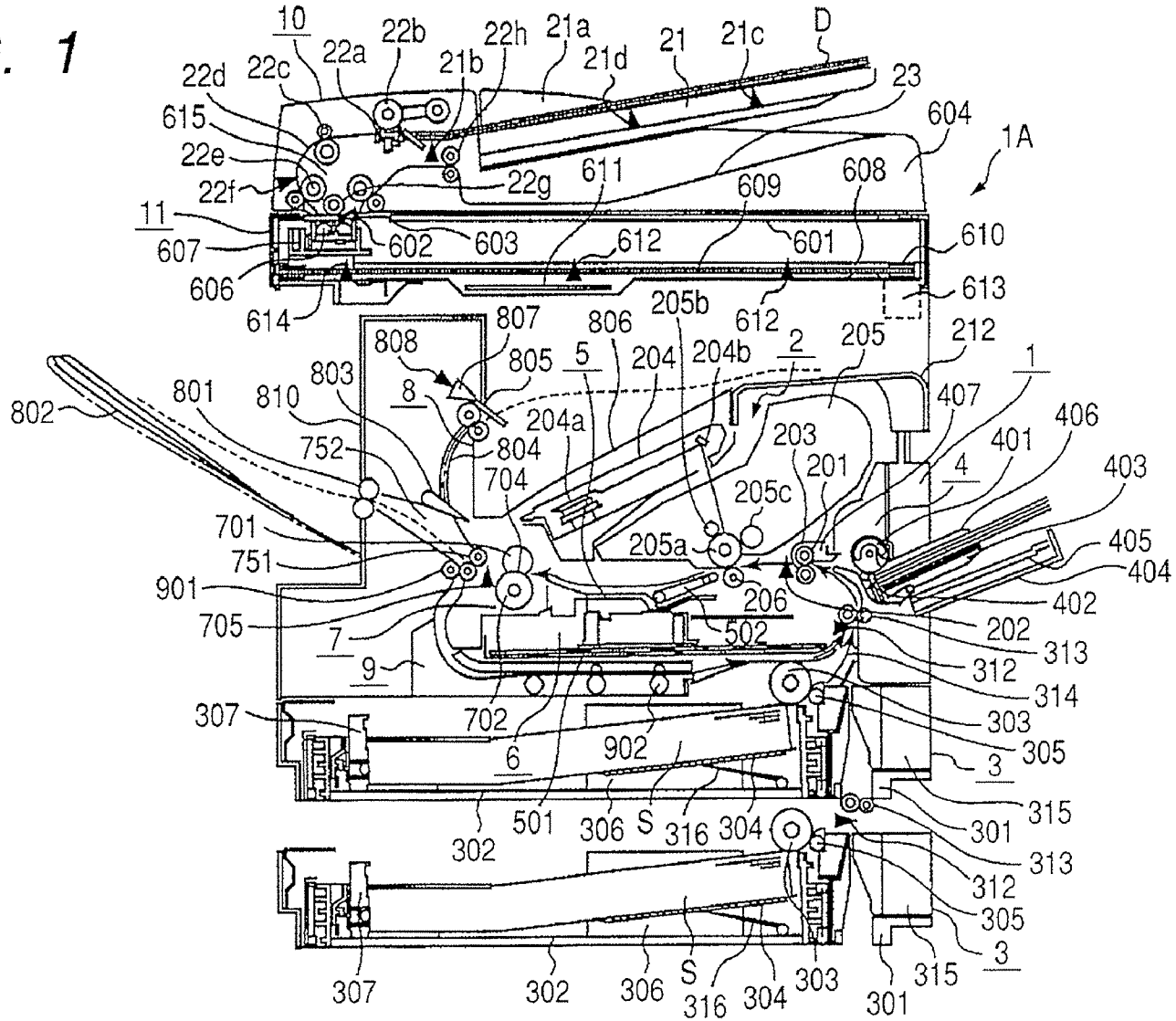
FIG. 1 schematically illustrates the construction of an image forming apparatus provided with a sheet feeding apparatus according to an embodiment of the present invention.
Figure 2:
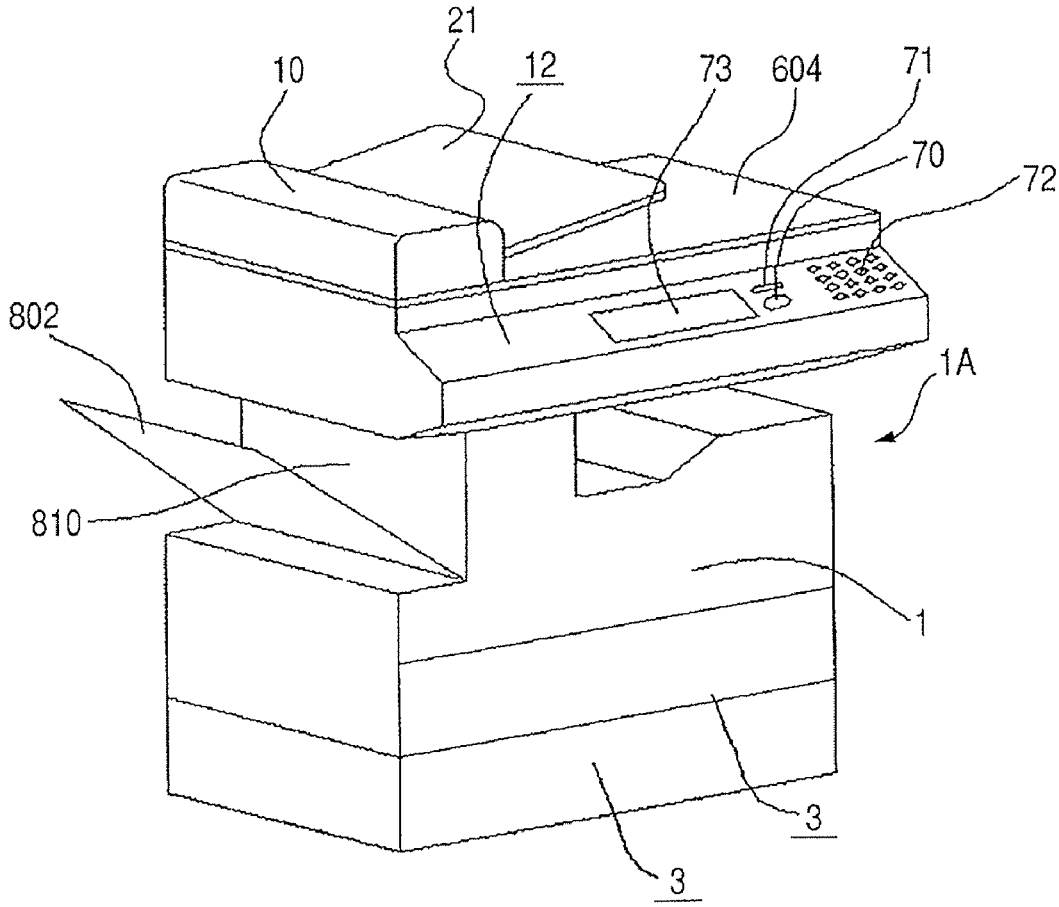
FIG. 2 is a pictorial perspective view of the image forming apparatus.

FIG. 1 schematically illustrates the construction of an image forming apparatus provided with a sheet feeding apparatus according to an embodiment of the present invention, and FIG. 2 is a pictorial perspective view thereof.

In FIGS. 1 and 2, an image reading portion 11 for reading the image information of an original D is provided in the upper portion of the image forming apparatus main body (hereinafter referred to as the apparatus main body) 1 of the image forming apparatus 1A. An image forming portion 2 is provided in the interior of the apparatus main body 1. The reference numeral 3 designates a sheet feeding apparatus, the reference numeral 4 denotes an MP (multi-paper) feeding portion, the reference numeral 6 designates a main body control portion for effecting the control of the entire apparatus, the reference numeral 7 denotes a fixing portion, the reference numeral 8 designates a surface reverse discharging portion, and the reference numeral 9 denotes a duplex conveying portion. Also, the reference numeral 10 designates an original conveying portion for stacking a plurality of originals thereon and conveying them one by one, the reference numeral 11 denotes an image reading portion for reading the image information of the originals D, and the reference numeral 12 designates an operating portion (shown in FIG. 2) constituted by an indicating portion, an input key, etc.

Each portion constituting the image forming apparatus 1A is described below.

The image reading portion 11 will first be described.

The image reading portion 11 is provided with an original plate 601, a flow reading glass plate 602 and a jump stand 603 on the upper surface thereof, and in the upper portion thereof, there is provided the original conveying portion 10 provided with an original pressure cover 604 through a hinge (not shown) disposed rearwardly of the image reading portion 11.

Also, in the interior of the apparatus, there are disposed a contact image sensor 606 which is image reading means, a carriage 607, a guide shaft 608, a timing belt 609, a driving pulley 610, an image processing relay substrate 611, and an original size detecting sensor 612 as an option.

Here, the contact image sensor 606 is a device comprising a one-dimensional photoelectric conversion element (not shown), a SELFOC lens (trademark), and light sources disposed on the opposite sides of the SELFOC lens (trademark), those being contained in a housing. This contact image sensor 606 is resiliently supported on the carriage 607 by a spring (not shown), and also is urged toward the original plate 601, and keeps a constant distance so that the distance thereof to the originals D disposed on the original plate 601 may not depart from the depth of focus.

The carriage 607 is connected to the timing belt 609 driven by a reading drive motor 613, and is reciprocally moved in the image reading portion 11 along the guide shaft 608 perpendicular to the one-dimensional photoelectric conversion element in the contact image sensor 606. Also, the position of the contact image sensor 606 is controlled by the rotation frequency and rotation time of the reading drive motor 613 with the detection timing of a home position sensor 614 as a base point.

Also, the original conveying portion 10 is provided with an original stacking stand 21 and a slider 21*a* slidable on the original stacking stand 21 in a width direction orthogonal to the conveying direction of the originals D, and the opposite side edges of the originals D stacked on the original stacking stand are adapted to be aligned by this slider 21*a*.

When the originals D are stacked on the original stacking stand 21, the pressure of the originals and the length of the originals are detected by an original detecting sensor 21*b* and a length detecting sensor 21*c*, respectively, and the width of the originals is detected by a width detecting sensor 21*d* based on the movement amount of the slider 21*a*. Then, detection signals from these sensors 21*b*, 21*c* and 21*d* are inputted to the main body control portion 6 in the apparatus main body 1, and a sheet of a predetermined size is selected according to a variable magnification inputted from the operating portion 12. If a sheet of an appropriate size is not present, it is displayed on the LCD (liquid crystal display) 73 (shown in FIG. 2) of the indicating portion of the operating portion 12.

The image reading operation of the image reading portion 11 provided with such an original conveying portion 10, etc. is described below.

When the originals D are stacked on the original stacking stand 21, and a start key 70 (shown in FIG. 2) on the operating portion 12 is depressed after the originals D are detected by the original detecting sensor 21*b*, the originals D are separated one by one by a separating roller 22*b* being in pressure contact with a separating pad 22*a*. Further, thereafter, the original D is conveyed to a U-turn sheet passing path 22*d* by original conveying roller 22*c*. Also, when the start key 70 is depressed, the contact image sensor 606 effects shading. Thereafter, the contact image sensor 606 is moved to below the flow reading glass plate 602 on a side opposite to the original plate 601 with the jump stand 603 interposed therebetween, and becomes stationary there.

Further, the original D passes an original leading edge detecting sensor 22*f* provided on the U-turn sheet passing path 22*d*, and thereafter is conveyed to a first image reading portion 615 by a feed roller 22*e*, etc. Then, the image of the original begins to be scanned at the timing whereat the leading edge of the original arrives at an image reading position whereat the contact image sensor 606 has been stopped. In this first original reading portion 615, the image information of the original D is read while the original D is brought close to the flow reading glass plate 602 by an original keeping roller 22*g*.

If the original detecting sensor 21*b* does not detect the originals and it is judged by the original size detecting sensor 612 that the original has been disposed on the original plate 601, which is a stationary reading side, the contact image sensor 606 scans the original plate 601 side.

Next, the image signal read in this manner is A/D-converted by the image processing relay substrate 611, thereafter it is sent to the read image processing portion 52 of the apparatus main body 1 shown in FIG. 3 which will be described later. The contact image sensor 606 and the image processing relay substrate 611 are electrically connected together by a flat cable (not shown).

Next, the image of the original D is read, thereafter the original D is scooped up from the upper surface of the flow reading glass plate 602 by the jump stand 603, and is discharged onto an original discharging tray 23 via original discharging rollers 22*h*. Then, all of the originals stacked on the original stacking stand 21 are read, and the original detecting sensor 21*b* detects the absence of the original D, whereupon the contact image sensor 606 is returned to its original standby position.

On the other hand, when the image of the original D disposed on the original plate 601 for copying is to be read, the original D is disposed on the original plate 601, and when the original conveying portion 10 provided with the original pressure plate 604 is closed, the size of the original is first detected by the original size detecting sensor 612.

Next, a copying start signal is transmitted, whereupon a sheet of a predetermined size is selected according to the detected size of the original and the information of the variable magnification inputted from the operating portion 12, and the feeding operation for a sheet S is started. If a sheet of an appropriate size is not present, it is displayed on the LCD 73. When the scanning is completed, the reading drive motor 613 is reversely rotated to return the contact image sensor 606 to its original standby position.

The sheet feeding apparatus 3 will now be described.

The sheet feeding apparatus 3 is constituted by a feeder portion 301 detachably mountable to the apparatus main body 1, a sheet feeding cassette 302 detachably mountable to the feeder portion 301, and a feed roller 303 for feeding sheets S contained in the sheet feeding cassette 302. A separating roller 305 is in pressure contact with the feed roller 303, and the sheets S stacked on the sheet feeding cassette 302 are fed by the feed roller 303, and thereafter are separated one by one by a separating portion constituted by the feed roller 303 and the separating roller 305 and are conveyed to the downstream side.

The feeder portion 301 has the function as a structure for supporting the apparatus main body 1 from below it, and a plurality of feeder portions can be connected to below the apparatus main body 1. In the present embodiment, design is made such that the feeder portion 301 (sheet feeding apparatus 3) can be mounted at two stages with respect to the apparatus main body 1. Also, in the present embodiment, the sheet feeding apparatus main body of the sheet feeding apparatus 3 is the same as the apparatus main body 1.

The sheet feeding cassette 302 which is a sheet containing portion is provided with a cassette inner plate 304 which is a sheet stacking plate movable up and down with the sheets S stacked thereon, a side regulating plate 306 for regulating the width direction of the sheets S, and a trailing edge regulating plate 307 for regulating the trailing edges of the sheets S.

The sheets S are adapted to be prevented from causing skew feed or non-feed by having their side edge surfaces regulated by the side regulating plate 306 movably mounted according to the sizes thereof. The cassette inner plate 304 is adapted to be pushed up by a pressure lever 316 for pressurizing the cassette inner plate disposed below it, and is thus pushed up, whereby the sheets S stacked on the cassette inner plate 304 are brought into pressure contact with the feed roller 303.

Figure 22:
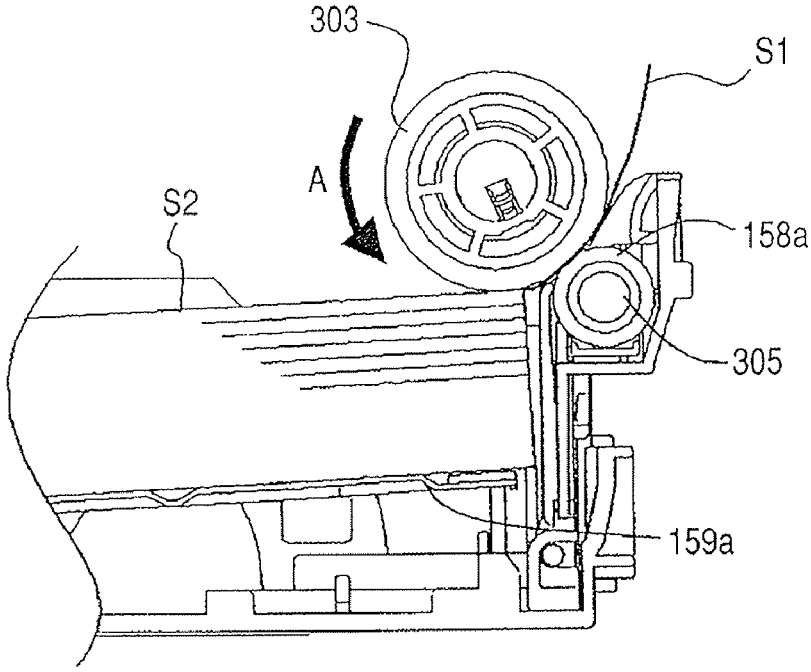
FIG. 22 illustrates the state of the sheet feeding apparatus during sheet feeding.
Figure 23:
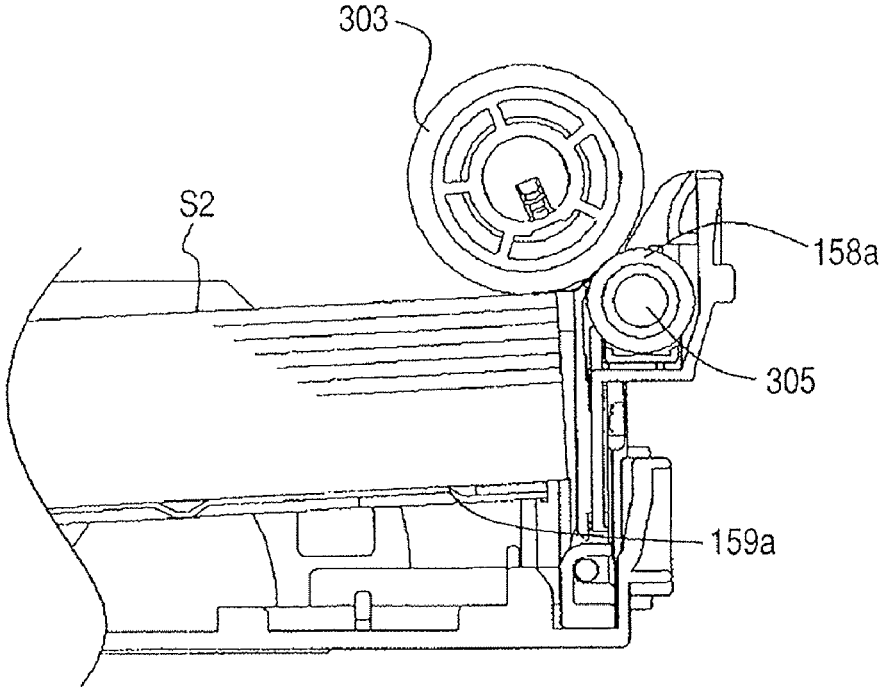
FIG. 23 illustrates the state when the sheet feeding operation of the sheet feeding apparatus has been completed.

As shown in FIGS. 22 and 23, the separating roller 305 having a torque limiter function is used as separating means. This separating roller 305 is in pressure contact with the feed roller 303 and also, contains a torque limiter 158*a* coaxially with or in the separating roller, and separates the sheets one by one by the braking torque of the torque limiter 158*a*.

In the case of such a separating roller 305, when for example, only one sheet is present between it and the feed roller 303, great rotation torque acts on the torque limiter 158*a* and therefore, the torque limiter 158*a* permits the rotation of the separating roller 305 with that of the feed roller 303. On the other hand, when a plurality of sheets are present between the separating roller and the feed roller 303, relatively small rotation torque acts on the torque limiter 158*a* and therefore, the torque limiter 158*a* is adapted to block the rotation of the separating roller 305 with that of the feed roller 303. By such action of the torque limiter 158*a*, one sheet is conveyed by the feed roller 303, and other sheets can be prevented from being conveyed by the separating roller 305.

Accordingly, the braking torque of the torque limiter 158*a* has as its lower limit the rotation torque which blocks the rotation of the separating roller 305 with that of the feed roller when a plurality of sheets are present between the separating roller and the feed roller 303. Also, it has as its upper limit the rotation torque which permits the rotation of the separating roller 305 with that of the feed roller when only one sheet is present between the separating roller and the feed roller 303. By the magnitude of the braking torque being controlled within this range, the sheet separating function and the feeding function can be displayed.

In this separating means, the sheets S are adapted to be separated one by one by the braking torque of the torque limiter 158*a*. When for example, one sheet is present between the feed roller 303 and the separating roller 305, great rotation torque acts on the torque limiter 158*a* and therefore, the torque limiter 158*a* permits the rotation of the separating roller 305 with that of the feed roller 303. Thereby, the sheet is conveyed.

On the other hand, when a plurality of sheets are present between the feed roller 303 and the separating roller 305, relatively small rotation torque acts on the torque limiter 158*a* and therefore, the torque limiter 158*a* blocks the rotation of the separating roller 305 with that of the feed roller. The torque limiter thus blocks the rotation of the separating roller 305 with that of the feed roller, whereby a sheet is conveyed by the feed roller 303 and the conveyance of the other sheets is blocked by the separating roller 305.

Now, in such a construction, after the sheets S stacked on the sheet feeding cassette 302 have been fed, the uppermost sheet S1 is adapted to be pulled out by a pair of downstream pulling-out rollers 313. When the sheet S1 is thus pulled out, the feed roller 303 is rotated in the direction indicated by the arrow A indicated in FIG. 22.

When the feed roller 303 is thus rotated, the sheet S2 next to the uppermost sheet S1 is conveyed to the nip portion between the feed roller 303 and the separating roller 305 by the feed roller 303 because of a construction in which a sheet is always in contact with the feed roller 303. At this time, the separating roller 305 is stopped from rotating at the moment when the sheet S1 has left the nip portion and therefore, as shown in FIG. 23, the sheet S2 is stopped with its leading edge folded.

When the sheet S2 is stopped in such state, if thereafter, the image forming operation is not performed for a long time (several days), a fold mark will remain on the leading edge of the sheet S2, and if an image is formed on the sheet S2 in this state, a faulty image will occur on the fold mark portion of the sheet S2.

So, in order to prevent the occurrence of such an inconvenience, it is conceivable to lower the sheet stacking plate 304 by a lifting and lowering mechanism which will be described later after the completion of the feeding operation, as shown, for example, in FIG. 24, and lower the sheets S stacked on the sheet stacking plate 304.

When the sheets S2 are thus lowered, stress applied to the leading edge portion of the sheets S2 in the nip portion between the feed roller 303 and the separating roller 305 is reduced and therefore, the fold mark can be prevented from remaining on the leading edge portion of the sheets S2, thus preventing the occurrence of a faulty image.

Also, this sheet feeding cassette 302 can stack about 500 sheets S thereon, and is designed to be capable of being pulled out in a forward direction relative to the apparatus main body 1 (front loading type). Further, sheets of various sizes (e.g. eight kinds, i.e. A3, A4, A5, B4, B5, leisure, letter and legal) can be stacked on the sheet feeding cassette 302, and the presence or absence of the sheets S is detected by a cassette sensor (not shown).

When in this sheet feeding apparatus 3, a sheet feeding command is outputted from the main body control portion 6 in the apparatus main body 1, the feed roller 303 which is sheet feeding means receives motive power from a motor (not shown), and performs the feeding operation for the sheets S by the connection of the motive power by a solenoid (not shown). The sheets thus fed by the feed roller 303 are separated one by one by the feed roller 303 and the separating roller 305. Further, the sheets S are conveyed to a pair of pulling-out rollers 313 provided on the downstream side while being upwardly curved in the separating portion.

A retry sensor 312 is provided between the separating roller 305 and the pair of pulling-out rollers 313. If the sheet S is not detected by the retry sensor 312 even after a predetermined time has passed after the sheet S has been fed, the main body control portion 6 rotates the feed roller 303 again to perform the feeding-out operation for the sheet S.

Next, the sheet S is conveyed to the pair of pulling-out rollers 313, and thereafter has its surface reversed by a conveying guide on which the pair of pulling-out rollers 313 are disposed, a sheet feeding U-turn guide constituted by a portion of a main body frame forming the skeleton of the apparatus main body 1, and an MP guide 407. The sheet S thus conveyed strikes against a registration shutter 203.

This registration shutter 203 is counter-clockwisely urged by a spring (not shown) at a point of time whereat the leading edge of the sheet S arrives at it, and stands by when the leading edge of the sheet S strikes against the end portion of the registration shutter in such a state, and the conveyance of the sheet S by the pair of pulling-out rollers 313 is effected also thereafter, the sheet S is flexed and a loop is formed.

When such a loop is formed, the leading edge side of the sheet S is made parallel to the end portion of the registration shutter 203 by the reaction force of the loop, whereby the skew feed of the sheet S is corrected. If still thereafter, the conveyance by the pair of pulling-out rollers 313 is further effected, the loop force overcomes the force of the spring urging the registration shutter 203, whereby the sheet S is conveyed to a pair of ante-transfer rollers 201 while pushing up the registration shutter 203.

Next, the sheet S having had its skew feed thus corrected by the registration shutter 203 and conveyed to the pair of ante-transfer rollers 201 is thereafter conveyed by the pair of ante-transfer rollers 201, and has its leading edge detected by a TOP sensor 202. When the TOP sensor 202 detects the leading edge of the sheet, the main body control portion 6 starts a toner image forming operation by the image forming portion which will be described later, based on the signal of the TOP sensor 202. Design is made such that if the TOP sensor 202 does not detect the leading edge of the sheet S within a predetermined time after the feeding of the sheet S has been started, it is judged as jam.

The MP (multi-paper) feeding portion 4 will now be described.

The MP feeding portion 4 is provided with an MP feed roller 401, an MP separating pad 402, an MP inner plate 403, an MP tray 404, an MP extension tray 405, an MP inner plate spring (not shown), and a sheet regulating plate 406. A plurality of sheets S placed on the MP inner plate 403 are conveyed to the pair of ante-transfer rollers 201 in the interior of the apparatus main body by the cooperation between the MP feed roller 401 and the separating pad 402.

Design is made such that during the use of the MP feeding portion 4, the openable and closable MP tray 404 is used about sheets of an ordinary size, and the MP extension tray 405 is pulled out about sheets of sizes which cannot be stacked on the MP inner plate 403. Design is made such that by the MP extension tray 405 being thus pulled out, the trailing edge of the sheet is prevented from protruding and hanging down from the MP tray 404.

Also, the MP inner plate 403 is upwardly urged by the MP inner plate spring, but the MP inner plate 403 is depressed in the standby state by a cam (not shown), and therefore it is possible to stack the sheets S on the MP inner plate 403.

In the MP feeding portion 4 of such a construction, when a signal commanding the start of MP feeding is outputted from the main body control portion 6 of the apparatus main body 1, a cam (not shown) is pivotally moved, and by the release of the depression of the MP inner plate 403, the stacked sheets S are brought into pressure contact with the semicircular MP feed roller 401. Thereafter, the sheets S stacked on the MP inner plate 403 are fed out by the MP feed roller 401, and thereafter are separated and conveyed one by one by a frictional piece separating method by the MP separating pad 402. Next, the separated sheet S continues to be pressure-conveyed by the MP feed roller 401 and the MP separating pad 402, joins a cassette sheet feed conveying path 314, and has its skew feed corrected by the registration shutter 203. Then, the sheet S is delivered to the pair of ante-transfer rollers 201, thereafter the leading edge of the sheet S is detected by the TOP sensor 202.

The image forming portion 2 will now be described.

The image forming portion 2 is provided with an image making portion, a sheet conveying portion 5 and the fixing portion 7. The image making portion is provided with a laser scanner 204, a process cartridge 205 provided with a photosensitive drum 205*a*, etc., and detachably mountable to the apparatus main body 1, a transfer roller 206, etc.

The laser scanner 204 is provided with a laser beam oscillator (not shown), a polygon mirror 204*a* and a turn-back mirror 204*b*. A scanning beam (modulated signal) emitted from the laser beam oscillator is applied to the turn-back mirror 204*b* via the polygon mirror 204*a*, and the scanning beam is reflected toward the photosensitive drum 205*a* by the turn-back mirror 204*b*.

The process cartridge 205 has integrally incorporated therein, besides the photosensitive drum 205*a*, a charging roller 205*b*, a developing sleeve 205*c*, a cleaning blade (not shown), a toner hopper, etc.

In such an image making portion, during image formation, the surface of the photosensitive drum 205*a* is uniformly charged by the charging roller 205*b*, and the scanning beam from the laser scanner 204 is applied to the surface thereof, whereby a latent image is formed thereon. Thereafter, the latent image is visualized by a toner supplied from the developing sleeve 205*c*, and the thus visualized toner image is adapted to be transferred to a sheet by the transfer roller 206.

The sheet conveying portion 5 serves to convey the sheet S to which the toner image formed on the surface of the photosensitive drum 205*a* has been transferred by the transfer roller 206 to the fixing portion 7, and has a conveying belt 502 and a conveying guide 501. By this sheet conveying portion 5, the conveyance of the sheet from the downstream of the photosensitive drum 205*a* to the fixing portion 7 is assisted and even the sheet S shorter than the length of the conveying path between the photosensitive drum 205*a* and the fixing portion 7 can be conveyed without the toner image thereon being disturbed.

The fixing portion 7 is provided with endless fixing film 701, a pressure roller 702, a pressure spring (not shown) for urging the pressure roller 702 toward the endless fixing film 701, and a fixing frame 703 for supporting them. A heater 704 is provided in the interior of the endless fixing film 701, and a temperature detecting sensor (not shown) is provided in contact with the surface of the heater 704. The fixing portion 7 and a pair of first sheet discharging rollers 751 are disposed in a sheet feeding path downstream of the image making portion.

Here, the endless fixing film 701 is rotatively driven by the driving force of the pressure roller 702, and as this endless fixing film 701, use is made of e.g. thin film of the order of 40 μm. Also, as the heater 704, use is made of a low heat capacity linear heating member. By thus using the thin endless fixing film 701, and also using the low heat capacity linear heating member as the heater 704, it is possible to realize the shortening of the rising time to a predetermined fixing temperature, and the saving of electric power.

On the downstream side of this fixing portion 7 with respect to the sheet feeding direction, there are disposed a pair of sheet discharging rollers 801 which are sheet discharging means for discharging the sheet S fixed by the fixing portion 7 from a side of the apparatus main body 1. Also, on a side of the apparatus main body 1 which is below the pair of sheet discharging rollers 801, a sheet discharging tray 802 for stacking thereon sheets discharged from the pair of sheet discharging rollers 801 is disposed so that the sheet stacking surface thereof may be inclined with the apparatus main body side thereof made lower.

In the thus constructed image forming portion 2, during image formation, the scanning beam from the laser beam oscillator is first applied to the surface of the photosensitive drum 205*a* based on the signal of the TOP sensor 202 to form a latent image on the surface of the photosensitive drum 205*a*. Thereafter, this latent image is visualized by the toner supplied from the developing sleeve 205*c*.

Next, the thus visualized toner image is transferred to the sheet S conveyed at such timing that the leading edge of the toner image formed on the photosensitive drum 205*a* and the leading edge of the sheet S coincide with each other, by the transfer roller 206. Thereafter, the sheet S to which the toner image has been transferred is conveyed to the fixing portion 7 by the sheet conveying portion 5 and further, the toner image is fixed on the sheet by the fixing portion 7, thereafter the sheet is discharged to a sheet discharging path 752 by a pair of fixing and sheet discharging rollers 751.

Here, between the fixing portion 7 and the pair of sheet discharging rollers 801, there is formed a sheet discharging and conveying path rising from the downstream side of the fixing portion 7 with respect to the sheet conveying direction toward the pair of sheet discharging rollers 801. The sheet S conveyed to the sheet discharging path 752 and stacked on the sheet discharging tray 802 by the pair of sheet discharging rollers 801 is discharged with its image-formed surface facing upward (so-called face-up discharge). In a case where the sheet S is thus face-up-discharged, the image-formed surface thereof is upside, and this leads to the merit that the state of the image can be recognized on the spot.

Also, above the image forming portion 2, there is disposed a sheet discharging portion 8 for reversing the surface of the sheet S on the upper surface of which the toner image has been fixed by the fixing portion 7 and conveying it to the pair of sheet discharging rollers 801. Also, a flapper 803 is provided at the entrance of the sheet discharging path 752, and design is made such that by switching this flapper 803, it is possible to select whether the sheet S conveyed from the fixing portion 7 is conveyed to the pair of sheet discharging rollers 801 or to a surface reverse conveying path 804.

Here, when conveyed to the surface reverse conveying path 804, and stacked on an upper sheet discharging tray 806 by a pair of upper sheet discharging rollers 805, the sheet S is discharged with its image-formed surface facing downward (so-called face-down discharge). In a case where the sheet S is thus face-down-discharged, there is the merit that the order of pages can be simply arranged properly.

Near the upper sheet discharging tray 806, there are disposed a full load detecting flag 807 and a full load detecting sensor 808 for detecting that the sheets S stacked on the upper sheet discharging tray 806 have exceeded a prescribed number of sheets. The full load detecting flag 807 is designed to downwardly keeps the sheets S so as to reliably stack the sheets S curled by being heated by the fixing portion 7 on the upper sheet discharging tray 806.

The duplex conveying portion 9 will now be described.

The duplex conveying portion 9 is disposed in the lower portion of the apparatus main body 1 for conveying a sheet having an image formed on one side thereof again to the image forming portion 2 when images are to be formed on the two sides of the sheet. In a case where images are to be formed on the two sides of the sheet, when the fixing sensor 705 first detects the trailing edge of the sheet S passed through the fixing portion 7, the pair of upper sheet discharging rollers 805 are reversely driven based on an image signal outputted from the main body control portion 6 after a predetermined time.

Thereby, the sheet S having an image formed on one side thereof is reversed, and is conveyed to the duplex conveying portion 9 by the pair of fixing and sheet discharging rollers 751 and a duplex conveying runner 901 in pressure contact with the pair of fixing and sheet discharging rollers 751. Then, the sheet S thus conveyed to the duplex conveying portion 9 has its edge portion aligned by a pair of oblique-feed rollers 902 provided in the duplex conveying portion 9, and joins a cassette sheet feeding and conveying path 314, and thereafter is conveyed to the image forming portion 2.

In FIG. 1, the reference numeral 212 designates a cartridge cover openably and closably provided on the apparatus main body 1, and by opening this cartridge cover 212, it is possible to interchange the process cartridge 205. Also, the apparatus main body 1 is provided with an interlock mechanism (not shown) so that the apparatus main body 1 may not operate when the cartridge cover 212 is opened or when the process cartridge 205 is not set on the apparatus main body 1.

The reference numeral 315 denotes a sheet feeding cover, and the reference numeral 810 designates a sheet discharging cover, and when jam occurs, it is possible to open one of the sheet feeding cassette 302, the cartridge cover 212, the sheet feeding cover 315 and the sheet discharging cover 810 to take out the sheet S stagnating in the interior.

Figure 3:
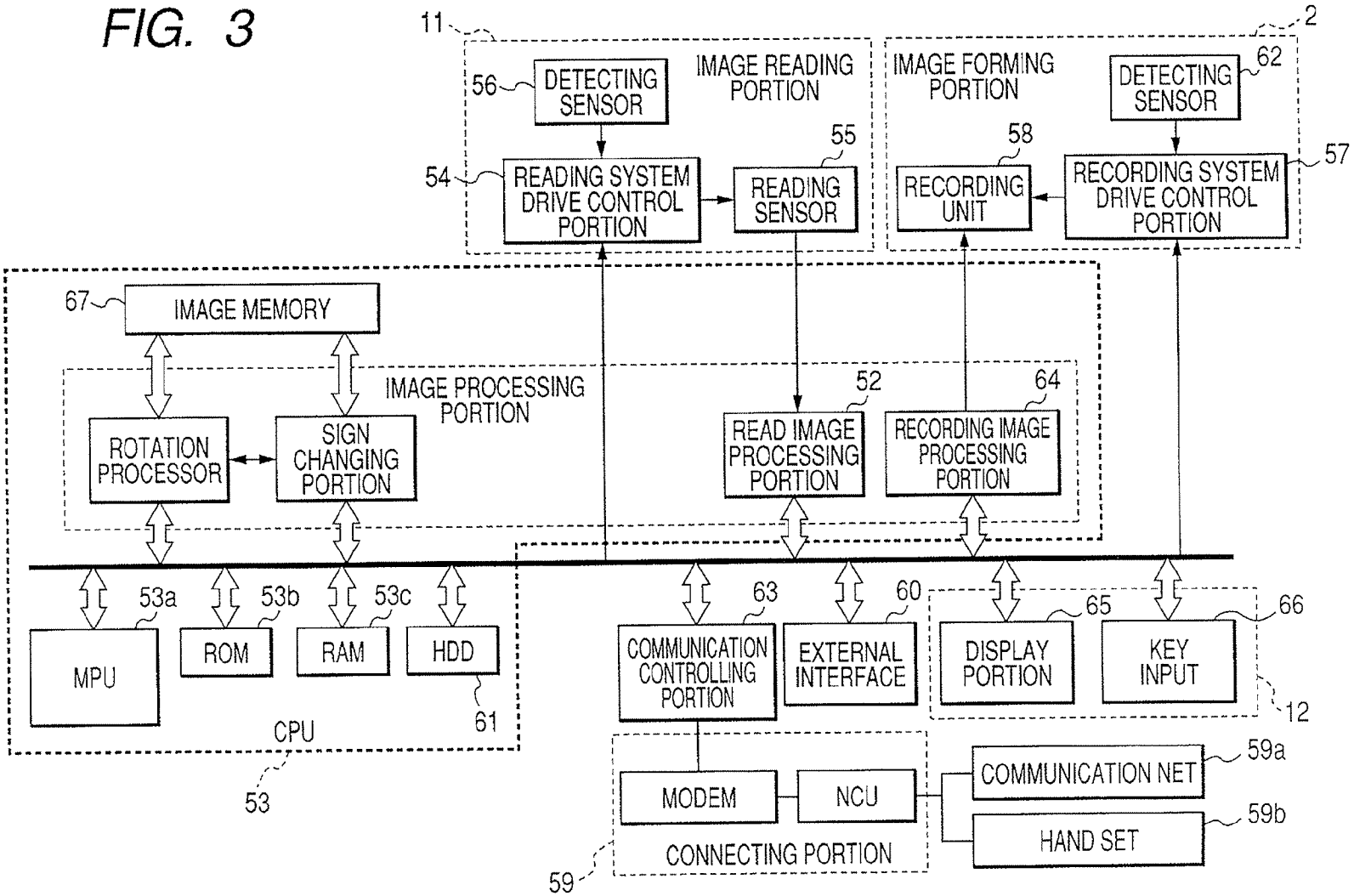
FIG. 3 is a block diagram of the main body control portion of the image forming apparatus.

FIG. 3 is a block diagram of the main body control portion 6 of the image forming apparatus 1A, and in FIG. 3, the reference numeral 53 denotes a CPU for controlling the entire copying machine. This CPU 53 is constituted by an MPU 53*a*, a ROM 53*b* storing the control program or the like of the MPU 53*a*, a RAM 53*c* used as a work area for various kinds of data processing and a temporary storage portion for the image information, and an image processing portion for carrying out the variable power of the image, the conversion of the degree of resolution, etc.

Also, this CPU 53 is provided with an HDD 61 used for the preservation of the image information, etc. as a non-volatile memory of a large capacity, a calendar of a known construction, a clock function, etc. That area of the RAM 53*c* which stores therein important system setting information such as one-touch key address information and software switch information is protected from an unexpected obstruction such as power failure by battery backup.

The operating portion 12 is constituted by a key input portion 66 comprising various key switches such as a start key 70, a stop key 71 and ten keys 72 shown in FIG. 2, and an indicating portion 65 provided with an LCD 73 shown in FIG. 2 for effecting the indication of various messages.

The image reading portion 11 is provided with a reading system drive control portion 54 such as a reading motor, a reading sensor 55 for effecting the reading of the image, a read image processing portion 52 for effecting the shading, binarization, edge emphasizing, smoothing, etc. of the read image, and various detecting sensors 56 for effecting the detection of the original, etc.

The image forming portion 2 is provided with a recording system drive control portion 57 such as a recording motor, a recording unit 58 for effecting the control, etc. of the laser scanner and the electrophotographic printing process based on a signal from a recorded image processing portion 64 for effecting the smoothing, etc. of an image to be recorded, and various detecting sensors 62 for effecting the detection of the sheet, etc.

The present image forming apparatus 1A has the function as a facsimile transmitting and receiving machine, and the control system when it functions as the facsimile transmitting and receiving machine is comprised of a communication main body controlling portion 63 and an external interface 60. This communication main body controlling portion 63 effects call out, call in, the encode of image data, etc. and is provided with a connecting portion 59 comprising a MODEM, an NCU, etc., and a communication net 59*a* and a handset 59*b* are connected to the connecting portion 59.

Also, the external interface 60 is an interface, which effects the transmission and reception of data directly from the CPU 53. For example, it is connected to a computer outside the apparatus and peripheral apparatuses through circuits such as RS232C, SCSI, LAN, USB, IEE1394 and an infrared ray, whereby the apparatus is used as the scanner printer or the like of the external computer, and functions as a host to the external peripheral apparatuses.

The details of the sheet feeding apparatus 3 are described below.

Figure 4:
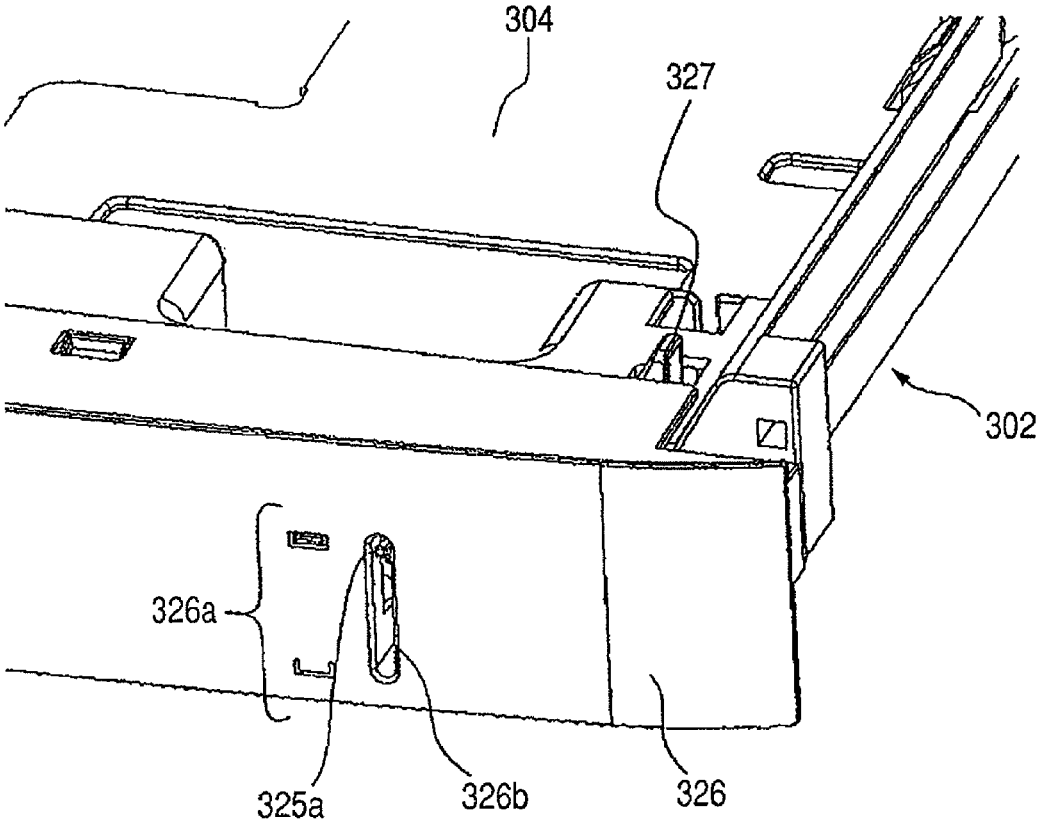
FIG. 4 is a front perspective view of a sheet feeding cassette provided in the sheet feeding apparatus.
Figure 5:
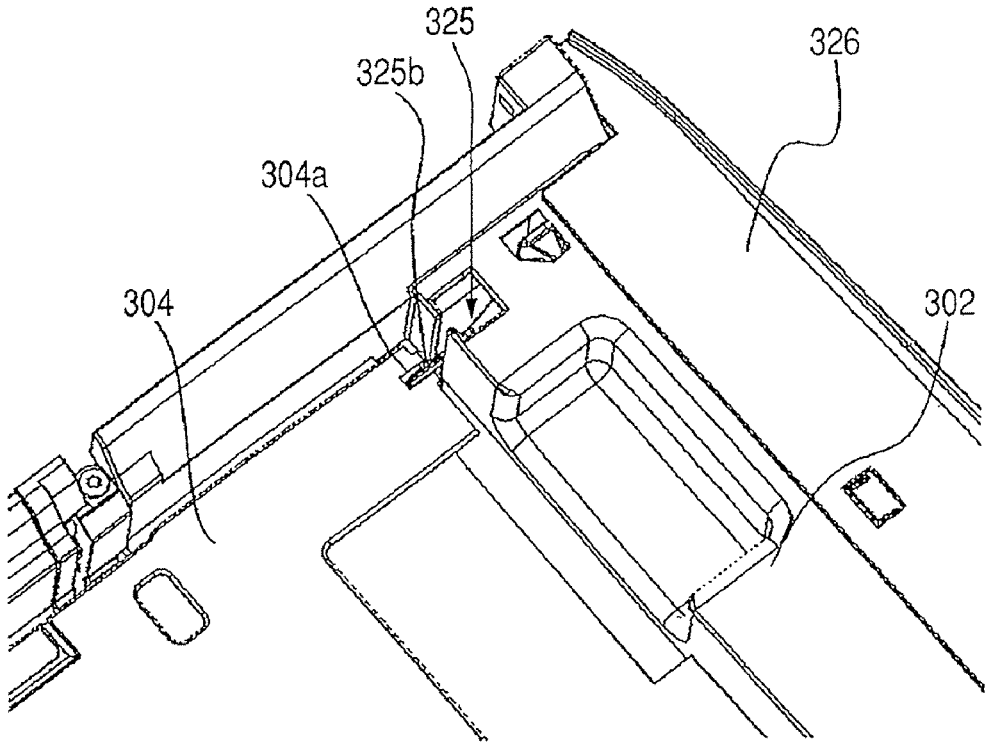
FIG. 5 is a rear perspective view of the sheet feeding cassette.

FIG. 4 is a front perspective view of the sheet feeding cassette provided in the sheet feeding apparatus 3, and FIG. 5 is a rear perspective view of the sheet feeding cassette. The upper and lower sheet feeding apparatus 3 and sheet feeding cassettes 302 are of the same construction.

In FIGS. 4 and 5, the reference numeral 326 designates a sheet feeding cassette cover provided on the front side of the sheet feeding cassette 302 with respect to the apparatus main body 1, and this sheet feeding cassette cover 326 is formed with an indication window 326*b* provided with an indication scale 326*a*. Also, the reference numeral 325 denotes a remaining amount indicating lever which is a remaining amount indicating member, and a pointer 325*a* is provided on one end of this remaining amount indicating lever 325, and this pointer 325*a* can be confirmed (visually confirmed) from the indication window 326*b* of the sheet feeding cassette cover, as shown in FIG. 4.

In the present embodiment, the upper side of the indication scale 326*a* shows by a figure that the remaining amount of sheets is great, and the lower side thereof shows by a figure that the remaining amount of sheets is small. Thus, by seeing at which position the pointer 325*a* of the remaining amount indicating lever 325 is relative to the indication scale 326*a*, the user can confirm the remaining amount of sheets from the outside of the sheet feeding cassette 302. For example, if the pointer 325*a* of the remaining amount indicating lever 325 is on the lower side of the indication scale 326*a*, it can be seen that the remaining amount of sheets has become small.

Here, this remaining amount indicating lever 325 is swingably provided in the sheet feeding cassette 302 and also, as shown in FIG. 5, is disposed so that the opposite other end portion 325*b* of the pointer 325*a* may rest on the bottom of the groove 304*a* in a cassette inner plate 304 pivotally provided in the sheet feeding cassette 302. Thereby, the remaining amount indicating lever 325 is adapted to swing with the movement of the cassette inner plate 304. This remaining amount indicating mechanism will be described in detail later.

Figure 6:
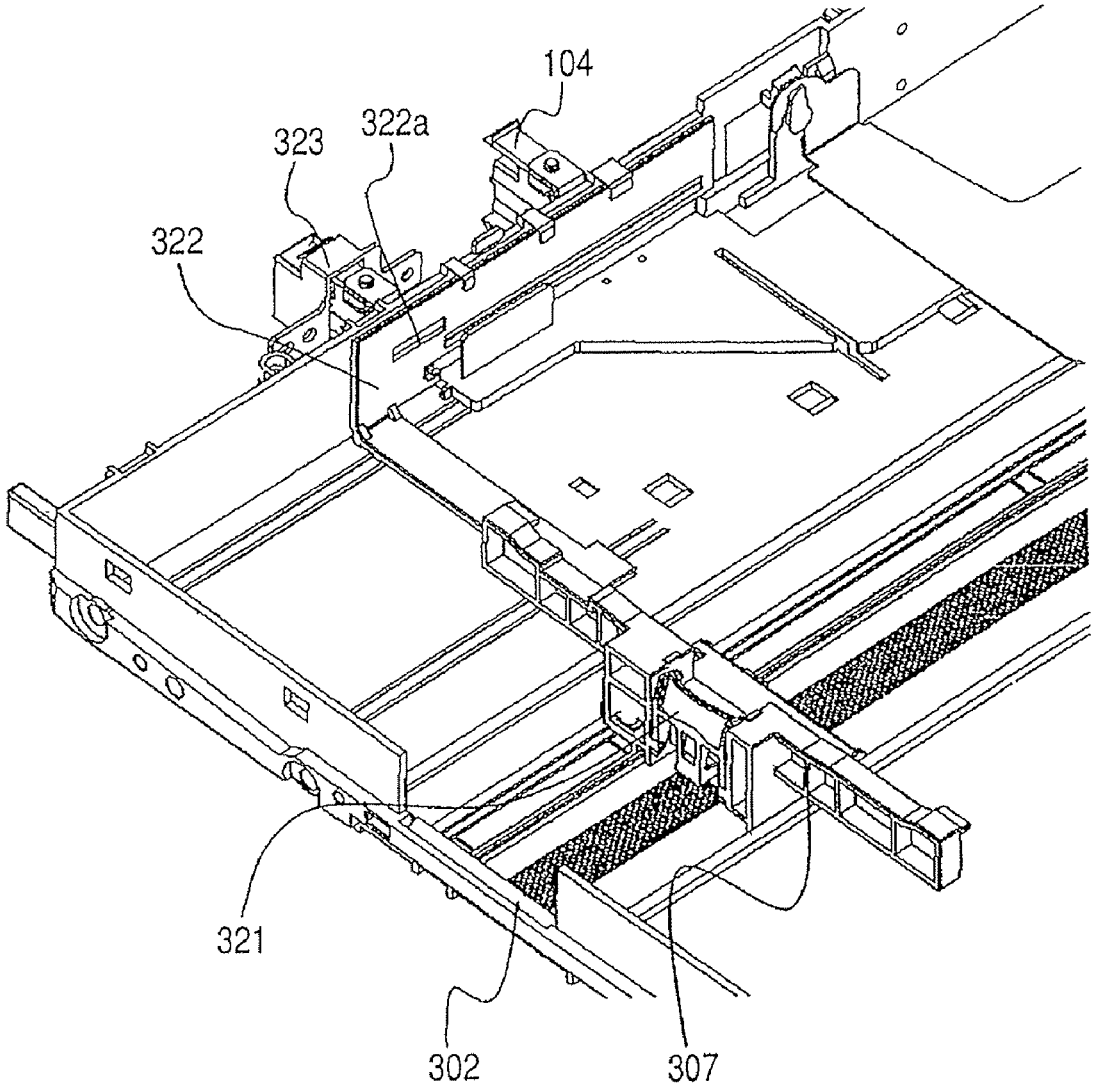
FIG. 6 illustrates a construction for detecting the length of sheets stacked on the sheet feeding cassette.

As shown in FIG. 6, the sheet feeding cassette 302 is provided with a trailing edge regulating plate 307 for regulating the trailing edge of the sheet, and this trailing edge regulating plate 307 is movable in the feeding direction by a trailing edge regulating lever 321 being operated.

In FIG. 6, the reference numeral 322 designates a detecting lever formed with a plurality of openings 322*a* and operable in association with the trailing edge regulating plate 307, and the reference numeral 323 denotes a length detecting sensor. This length detecting sensor 323 serves to detect the combination of the openings 322*a* moved with the movement of the length detecting lever 323 operably associated with the trailing edge regulating plate 307 to detect the length of the sheet in the feeding direction.

Figure 7:
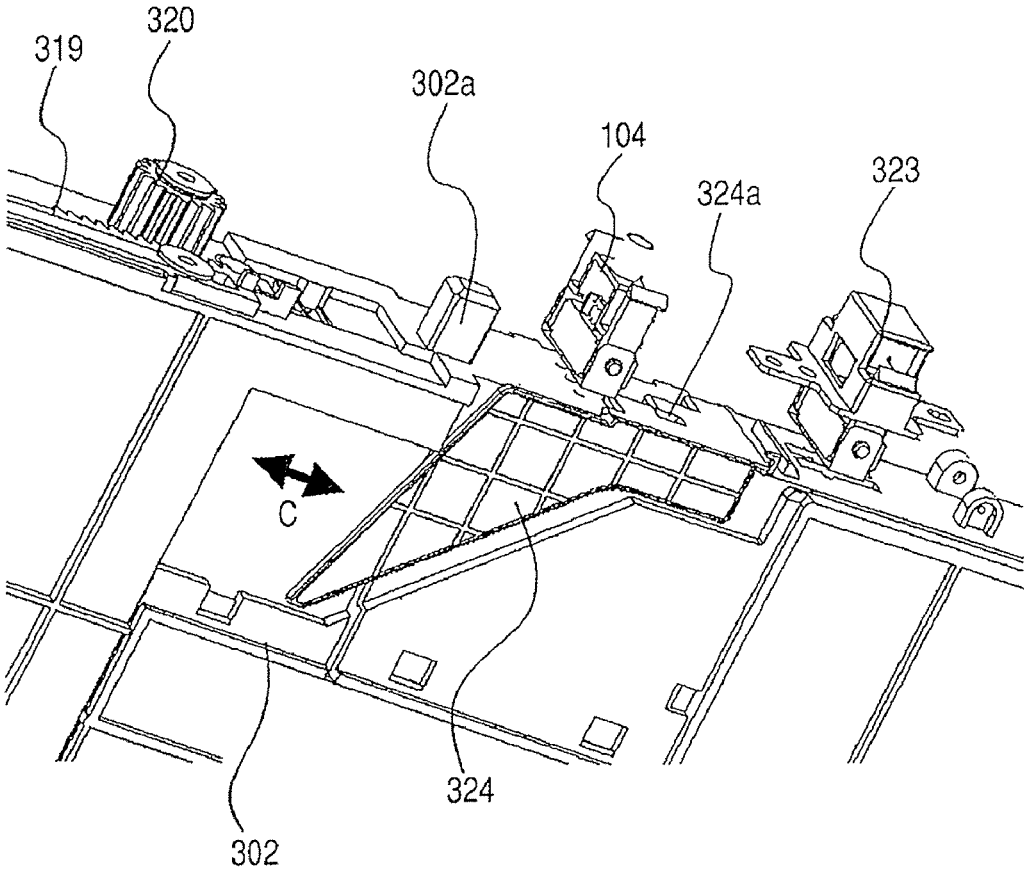
FIG. 7 illustrates a construction for detecting the widthwise length of the sheets stacked on the sheet feeding cassette.

Also, the sheet feeding cassette 302 is provided with a side regulating plate 306 (see FIG. 1) for regulating the width direction of the sheet, and this side regulating plate 306 is movable in the direction indicated by the arrow C in operative association with a width detecting lever 324 shown in FIG. 7. The width detecting lever 324 is formed with a plurality of openings 324*a*, and a width detecting sensor 104 can detect the combination of these openings 324*a* to detect the length of the sheet in the width direction thereof.

Here, design is made such that when the sheet feeding cassette 302 is inserted into the apparatus main body 1, the lengths of the sheet in the feeding direction and the width direction thereof are detected by the length detecting sensor 323 and the width detecting sensor 104, and these data are inputted to the main body control portion 6. The main body control portion 6 can recognize the size of the sheets set on the sheet feeding cassette 302 from information obtained from the length detecting sensor 323 and the width detecting sensor 104.

A lifting and lowering mechanism for lifting and lowering (pivotally moving) the cassette inner plate 304 is described below. The lifting and lowering mechanism is provided to lift the cassette inner plate 304 to urge the stacked sheets toward the feed roller 303 (shown in FIG. 1).

As already described, the pressure lever 316 for pressing the cassette inner plate is disposed for pivotal movement in the vertical direction in the lower portion of the cassette inner plate 304, and when this pressure lever 316 is pivotally moved in one direction, the cassette inner plate 304 and the sheets are adapted to be pushed up.

Figure 8:
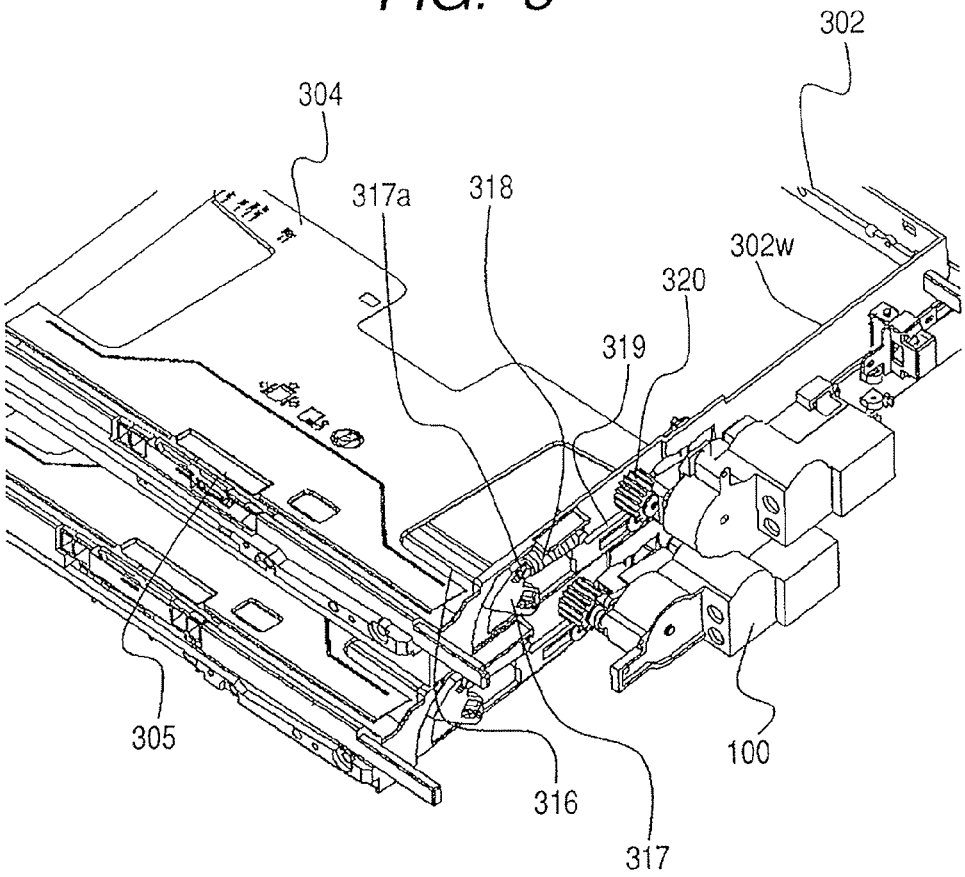
FIG. 8 is a first view illustrating a mechanism for pivotally moving a pressure lever provided in the sheet feeding cassette.
Figure 9:
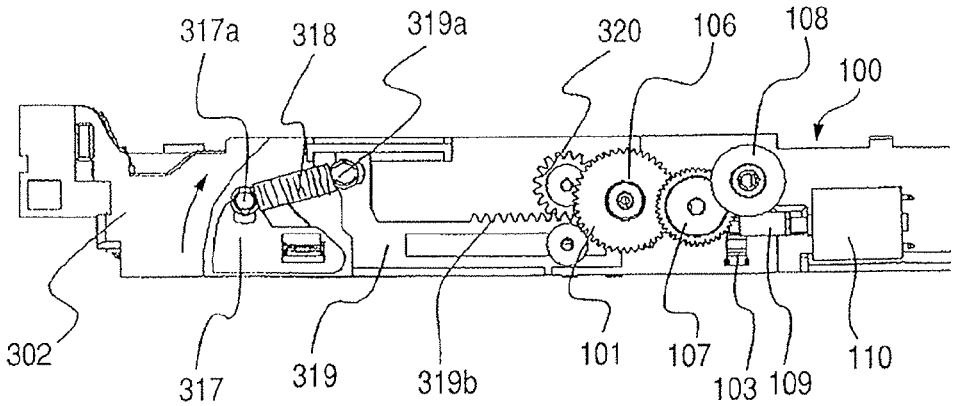
FIG. 9 is a second view illustrating the mechanism for pivotally moving the pressure lever provided in the sheet feeding cassette.

FIGS. 8 and 9 show a mechanism for thus pivotally moving the pressure lever 316. In FIGS. 8 and 9, the reference numeral 320 designates a cassette gear rotatably provided on the rear surface wall 302*w* of the sheet feeding cassette 302, and the reference numeral 317 denotes a pressure arm provided on one end portion of the pressure lever 316.

An inner plate spring 318 is provided on a projected portion 317*a* provided on the pressure arm 317. This inner plate spring 318 is an urging member for urging the cassette inner plate 304 toward the feed roller 303 to generate sheet feeding pressure between the sheets stacked on the cassette inner plate 304 and the feed roller 303. This urging member is not restricted to the spring, but may be means such as a wire.

The reference numeral 319 designates a rack member movably provided on the rear surface wall 302*w* of the sheet feeding cassette 302, and provided with a gear portion 319*b*, and one end of the inner plate spring 318 is restrained on the projected portion 319*a* of the rack member 319. Also, the gear portion 319*b* of this rack member 319 is designed to mesh with a cassette gear 320.

The reference numeral 100 denotes a pressure drive unit provided with a pressure motor 110. The drive of this pressure drive unit 100 is adapted to be transmitted to the pressure lever 316 through the cassette gear 320, the rack member 319 and the pressure arm 317.

Figure 13:
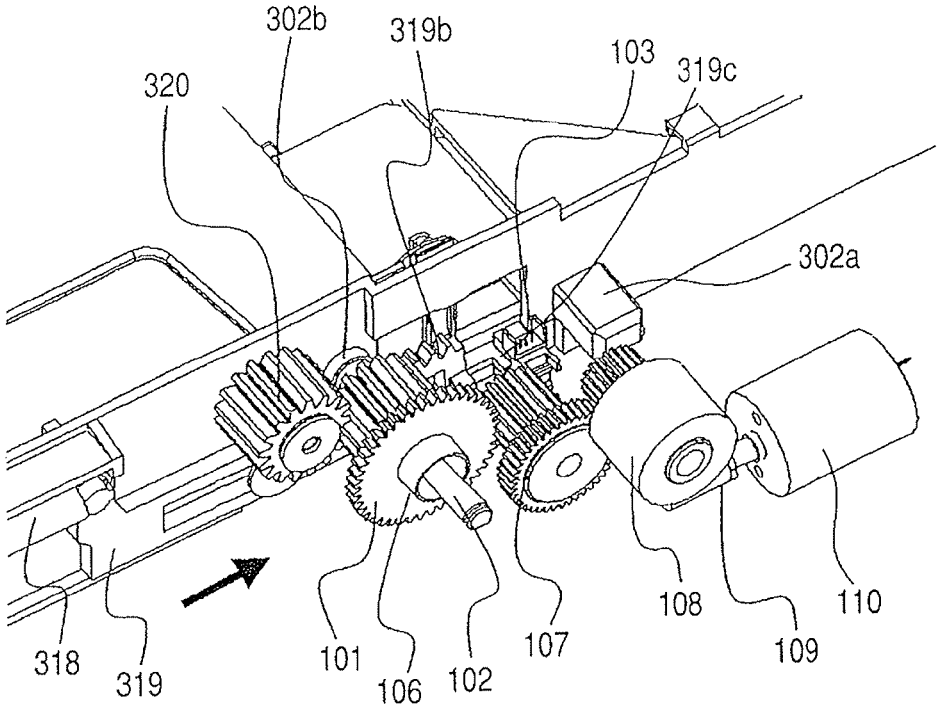
FIG. 13 is a first view illustrating the operation of the pressure drive unit.

In FIG. 9, the reference numeral 103 designates a photointerruptor for detecting a projected portion 319*c* for detection provided on a rack member 319*b* shown in FIG. 13, which will be described later, and this photointerruptor 103 is provided for each of the upper and lower sheet feeding cassettes 302.

The drive transmission of the pressure drive unit 100 to the rack member 319 is described below.

Figure 10:
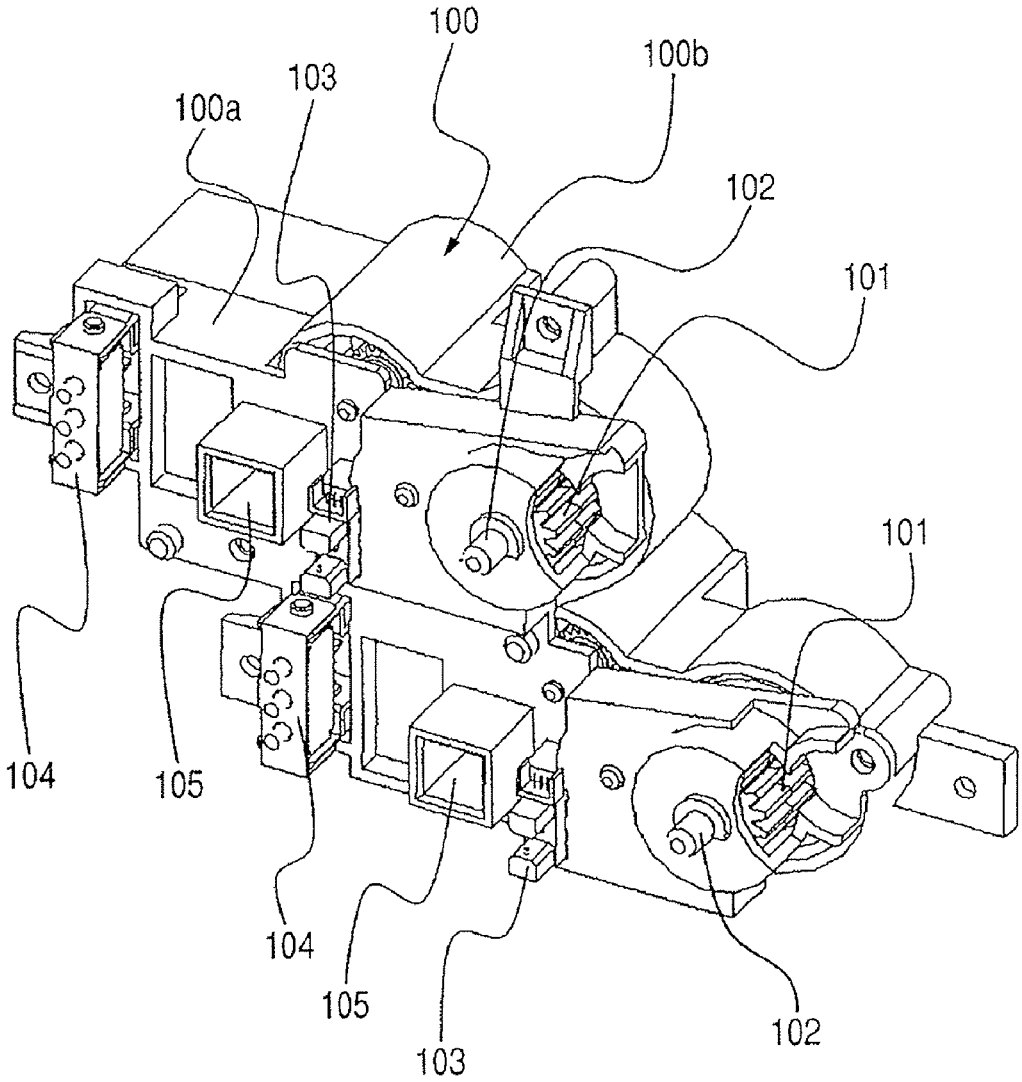
FIG. 10 is a first view illustrating the construction of a pressure drive unit provided on an image forming apparatus main body side.

FIG. 10 shows the construction of the pressure drive unit 100 provided on the apparatus main body side, and in FIG. 10, the reference character 100*a* designates the front of a driving frame, and the reference character 100 denotes the rear of the driving frame. The reference numeral 101 designates a drive transmitting gear meshing with the cassette gear 320 provided on the sheet feeding cassette 302, and in the present embodiment, two such drive transmitting gears are disposed to transmit the drive to the upper and lower sheet feeding cassettes 302.

Figure 11:
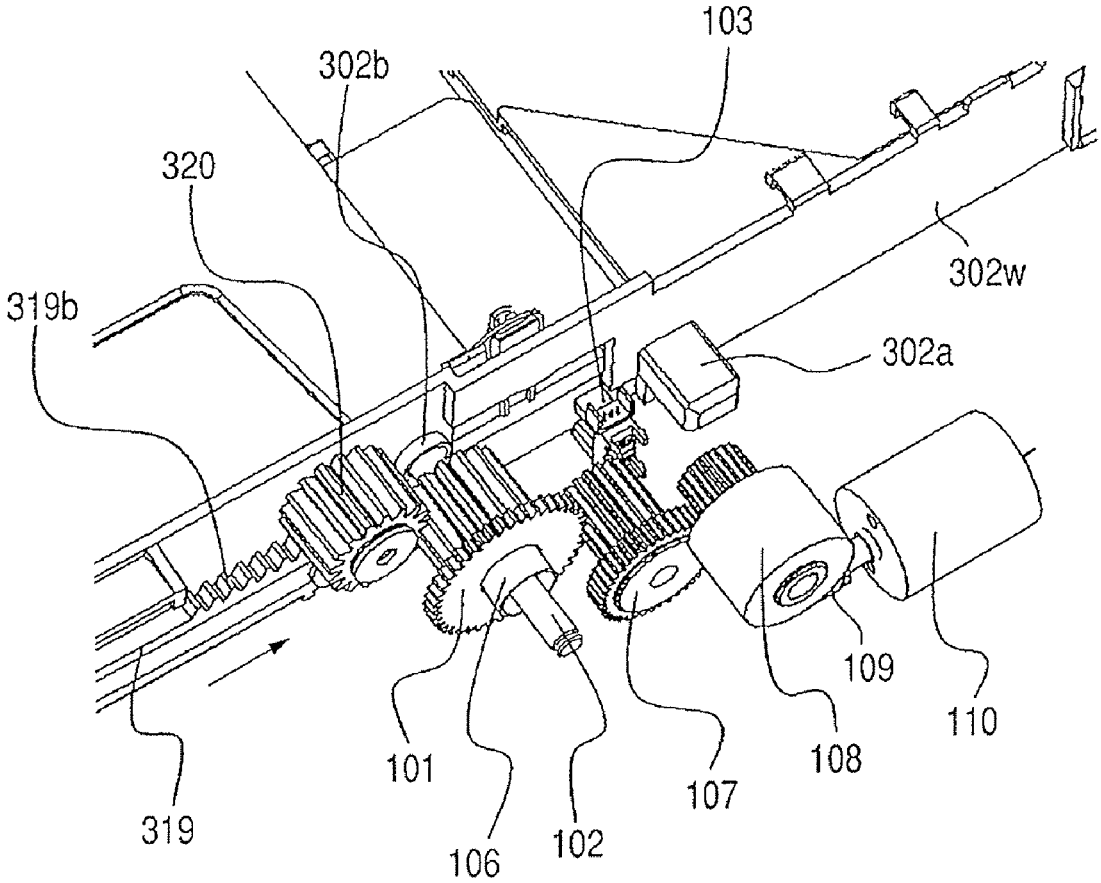
FIG. 11 is a second view illustrating the construction of the pressure drive unit.

The reference numeral 105 denotes a positioning aperture which is formed in the front 100*a* of the driving frame and in which is fitted a positioning boss 302*a* projectedly provided on the rear surface wall 302*w* of the sheet feeding cassette 302, as shown in FIG. 11. This positioning aperture 105 is provided for each of the upper and lower sheet feeding cassettes 302. The rear surface wall 302*w* of the sheet feeding cassette 302, as shown in FIG. 11, is formed with a positioning aperture 302*b* in which is inserted a drive transmitting shaft 102 for rotatably holding the drive transmitting gear 101.

By such positioning aperture 105, positioning boss 302*a*, drive transmitting shaft 102 and positioning aperture 302*b*, the positioning of the sheet feeding cassette 302 is reliably effected when the sheet feeding cassette 302 is mounted. Also, the distance between the shafts of the drive transmitting gear 101 and the cassette gear 320 can be kept accurately, and the driving force of the pressure drive unit 100 is smoothly transmitted to the pressure lever 316.

Figure 12:
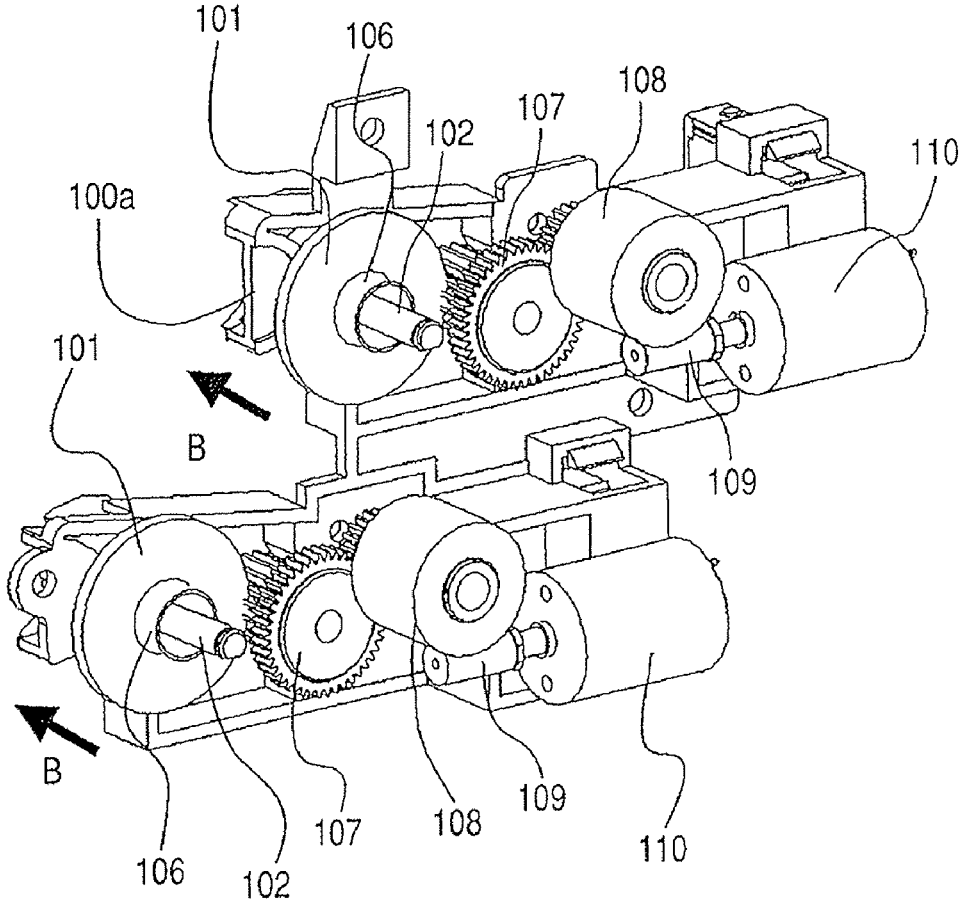
FIG. 12 is a third view illustrating the construction of the pressure drive unit.

Now, the drive transmitting gear 101 is urged in the direction indicated by the arrow B by a gear spring 106, as shown in FIG. 12. Thereby, the drive transmitting gear 101 can be retracted in a direction opposite to the direction indicated by the arrow B when during the insertion of the sheet feeding cassette, the teeth of the cassette gear 320 and the teeth of the drive transmitting gear 101 do not smoothly mesh with each other.

As the result, any damage to the cassette gear 320 and the drive transmitting gear 101 can be prevented. Even if the drive transmitting gear 101 is thus retracted, when the drive transmitting gear 101 is moved to a position in which it meshes with the cassette gear 320 by, the rotation of a pressure motor 110 which will be described later, the drive transmitting gear 101 is pressed by the gear spring 106 and comes into meshing engagement with the cassette gear 320.

In FIG. 12, the reference numeral 110 designates a pressure motor for rotatively driving a worm gear 109 which is speed reducing means, and this pressure motor 110 is provided for each of the upper and lower sheet feeding cassettes, and is fixed to the rear 100*b* of the driving frame. By providing the worm gear 109 as the speed reducing means, a greater speed reduction ratio is obtained and therefore, the pressure drive unit 100 can be compacted in size.

The drive transmitting gear 101, for example, as shown in FIG. 11, is designed to mesh with the worm gear 109 through a first speed reduction gear 107 and a second speed reduction gear 108. The first speed reduction gear 107 and the second speed reduction gear 108 are rotatably held by shafts (not shown) provided on the rear 100*b* of the driving frame, and these speed reduction gear shafts (not shown) are adapted to fit in the aperture portion of the front 100*a* of the driving frame and be positioned.

Here, when the sheet feeding cassette 302 is inserted into the apparatus main body 1, the pressure motor 110 is driven by the main body control portion 6, and the driving force of this pressure motor 110 is transmitted to the drive transmitting gear 101 through the worm gear 109, the second speed reduction gear 108 and the first speed reduction gear 107. Further, the drive of this drive transmitting gear 101 is transmitted to the cassette gear 320 on side of the sheet feeding cassette 302 meshing with the gear portion 319*b* of the rack member 319, whereby the rack member 319 is moved in the direction indicated by the arrow in FIG. 11.

When the rack member 319 is thus moved, the inner plate spring 318 is pulled, whereby the pressure arm 317 will soon begin to be pivotally moved in a clockwise direction indicated by the arrow in FIG. 9. Here, when the rack member 319 is thus moved, the photointerruptor 103 will soon detect the projected portion 319*c* for detection provided on the rack member 319*b* shown in FIG. 13. The detection signal of this photointerruptor 103 is transmitted to the main body control portion 6, whereby the driving of the pressure motor 110 is stopped.

Figure 14:
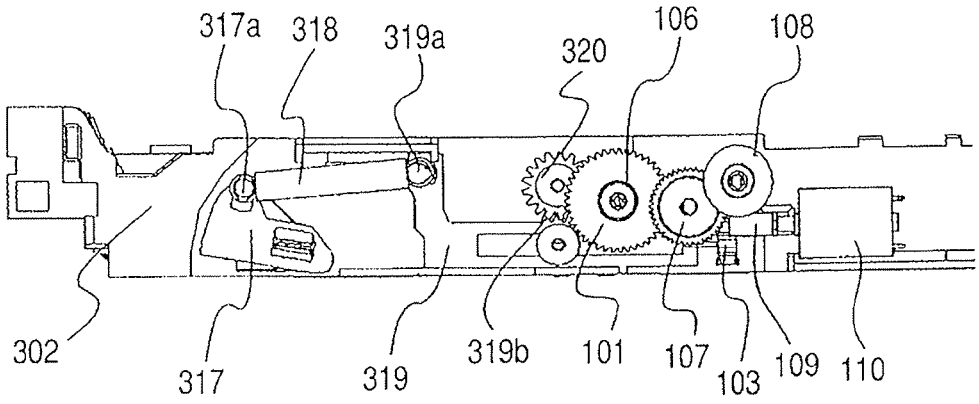
FIG. 14 is a second view illustrating the operation of the pressure drive unit.

When the driving of the pressure motor 110 is thus stopped, the pressure arm 317 is pivotally moved by the inner plate spring 318 and is moved to a position shown in FIG. 14, and along therewith, the pressure lever 316 having the pressure arm 317 attached to one end thereof is also pivotally moved.

Then, by the pivotal movement of this pressure lever 316, the cassette inner plate 304 is pushed up as shown in FIG. 1, and the sheets S stacked on the cassette inner plate 304 come into pressure contact with the feed roller 303 to generate predetermined sheet feeding pressure. By such sheet feeding pressure being generated, a driving force occurs to the pressure drive unit 100 in a reverse direction, but the pressure drive unit 100 is adapted not to be reversely rotated due to the relation between the lead angle and friction angle of the worm gear 109 meshing with the second reduction gear 108.

Now, in the present embodiment, the separating roller 305 (shown in FIGS. 1 and 22) in pressure contact with the feed roller 303 to constitute a sheet separating portion is provided with a torque limiter (not shown) connected coaxially with the separating roller 305, as already described.

This sheet separating portion is such that when for example, a sheet is present between the feed roller 303 and the separating roller 305, the torque limiter permits the rotation of the separating roller 305 with the rotation of the feed roller 303. On the other hand, when a plurality of sheets are present between the feed roller 303 and the separating roller 305, the torque limiter blocks the rotation of the separating roller 305 with the rotation of the feed roller.

By the torque limiter thus blocking the rotation of the separating roller 305 in association with the rotation of the feed roller, a sheet is conveyed by the feed roller 303 and the conveyance of the other sheets is blocked by the separating roller 305.

However, in the sheet feeding apparatus 3 according to the present embodiment, after the uppermost one of the sheets S stacked on the sheet feeding cassette 302 has been fed, if the sheets S are pulled out by the pair of downstream pulling-out rollers 313, the feed roller 303 is rotated in a counter-clockwise direction indicated in FIG. 1. At this time, the sheets stacked on the cassette inner plate are always in contact with the feed roller 303 and therefore, the next uppermost one of the stacked sheets is conveyed to the nip portion between the feed roller 303 and the separating roller 305 by the rotating motion of the feed roller 303 rotated in association with the rotation of the pulling-out rollers 313.

Here, the separating roller 305 is stopped from rotating at the moment when the sheet S has left the nip portion and therefore, as already described in connection with FIG. 23, there is the possibility of a fold mark remaining on the leading edge portion of the sheet S. In the present embodiment, however, design is made such that when a feeding start signal is not outputted within a predetermined time after the completion of the feeding operation, a signal for reversely driving the pressure motor 110 is transmitted from the main body control portion 6. Thereby, the pressure motor 110 is reversely rotated and the driving force of the pressure motor 110 is transmitted to the drive transmitting gear 101 through the worm gear 109, the second speed reduction gear 108 and the first speed reduction gear 107. Further, the drive of this drive transmitting gear 101 is transmitted to the cassette gear 320 on the sheet feeding cassette 302 side meshing with the gear portion 319*b* of the rack member 319, whereby the rack member 319 is moved in a direction opposite to the direction indicated by the arrow in FIG. 13.

The reversely driving time of the pressure motor 110 is the same as the time from the start of the driving of the pressure motor during the sheet feeding operation stored in the RAM 53*c* (see FIG. 3) of the CPU 53 until the photointerruptor 103 detects the projected portion 319*c* for detection on the rack member 319. Accordingly, the reversely driving time becomes long and the rack member 319 is returned more than to the initial standby position, and there does not arise the problem that the parts are damaged.

By such reverse driving of the pressure motor 110, the pressure arm 317 connected to the inner plate spring 318 is pivotally moved in a counter-clockwise direction opposite to the direction indicated by the arrow in FIG. 9, and along therewith, the pressure lever 316 is pivotally moved away from the cassette inner plate 304.

Figure 24:
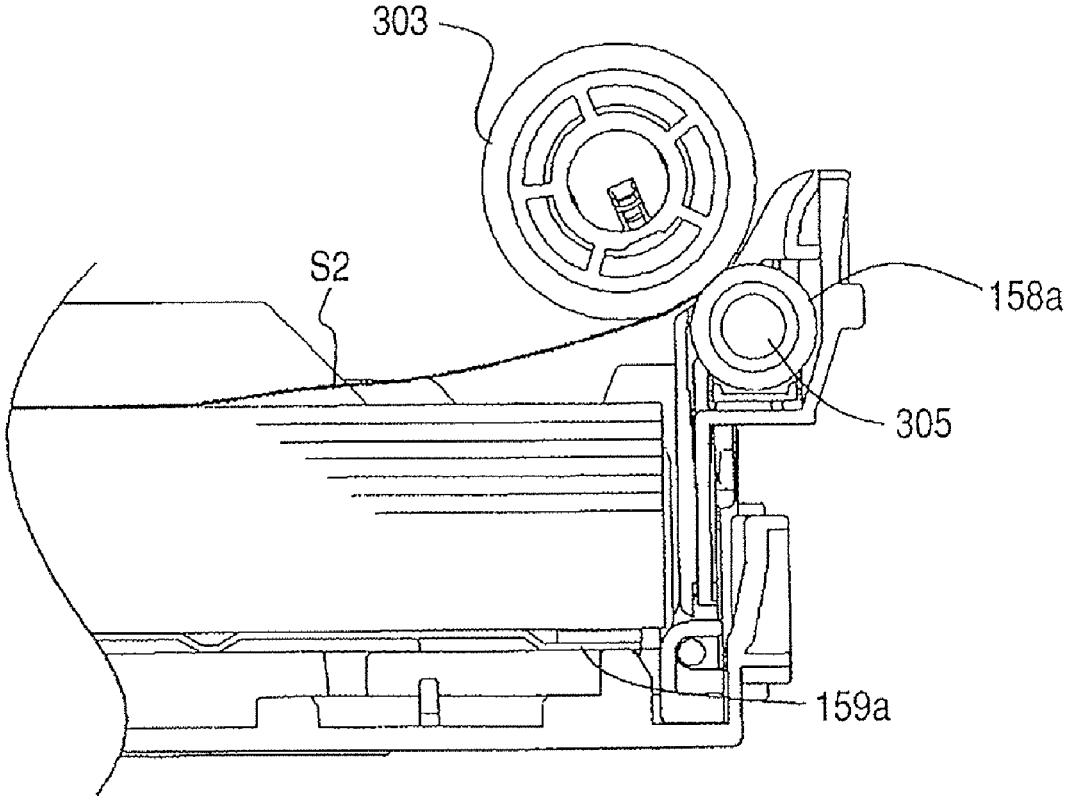
FIG. 24 illustrates the state when the sheet stacking plate of the sheet feeding apparatus has been lowered.

As the result, the cassette inner plate 304 is lowered and the sheets S stacked on the cassette inner plate 304 are lowered and therefore, as shown in FIG. 24, the stress applied to the leading edge portion of the sheets S is reduced, and a fold mark can be prevented from remaining on the leading edge portion of the sheet S2. Further, the occurrence of a faulty image due to the fold mark can be prevented.

However, when the cassette inner plate 304 is thus lowered after the completion of the feeding operation, it becomes impossible to indicate a correct remaining amount of sheets contained in the sheet feeding cassette 302 because as already described, the remaining amount indicating lever 325 is adapted to swing in operative association with the cassette inner plate 304.

So, the remaining amount indicating mechanism of the present invention for solving this problem is described below.

In the present embodiment, design is made such that even if the cassette inner plate 304 is lowered, the remaining amount indicating lever 325 is held at a position before the cassette inner plate 304 is lowered, and the remaining amount indicating lever 325 can indicate the correct remaining amount of sheets during the completion of the feeding operation.

A remaining amount indication holding mechanism is described below. The remaining amount indication holding mechanism is a holding mechanism for holding the remaining amount indicating lever 325 at a position before the cassette inner plate 304 is lowered, when such a cassette inner plate 304 is lowered.

Figure 15:
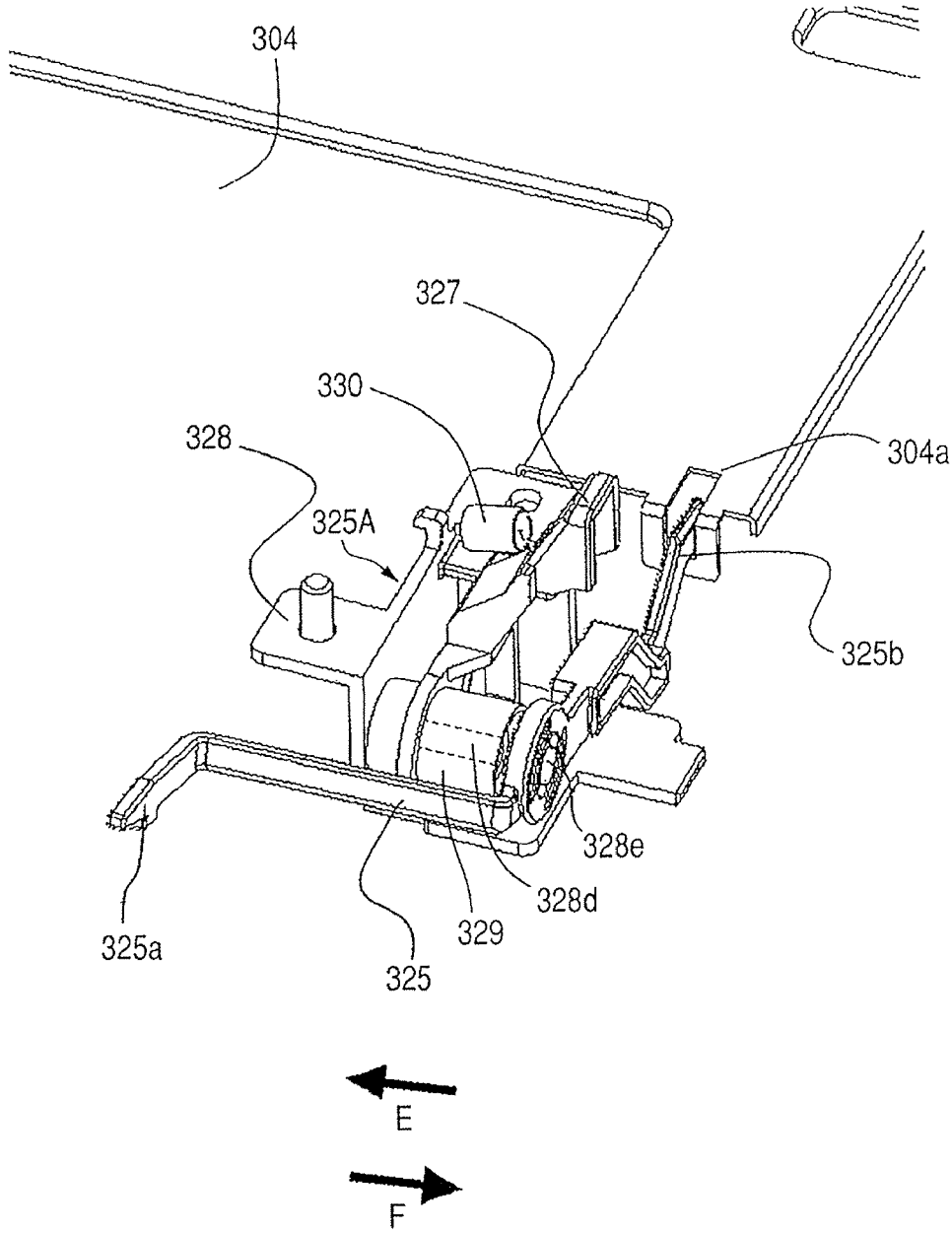
FIG. 15 is a perspective view of a remaining amount indication holding mechanism provided in the sheet feeding cassette.

FIG. 15 is a perspective view of the remaining amount indication holding mechanism 325A provided in the sheet feeding cassette 302. In FIG. 15, the reference numeral 328 designates a remaining amount indication holder, and a remaining amount indicating lever 325 is pivotally held on this remaining amount indication holder 328 through a shaft 328*d*. This remaining amount indicating lever 325 is designed such that the cassette inner plate side thereof is lowered with the aid of gravity because the position of the center of gravity of the remaining amount indicating lever 325 is normally located on the cassette inner plate 304 side of the shaft 328*d*. Therefore, in an ordinary state, one end of the remaining amount indicating lever 325 is engaged with the bottom of the groove 304*a* in the cassette inner plate 304. Also, as shown in FIG. 4, a pointer 325*a* provided on the other end side of the remaining amount indicating lever 325 is disposed so as to be capable of being seen from the indication window 326*b* of a sheet feeding cassette cover 326. The remaining amount indicating lever 325 may be urged by a weak spring so that one end thereof may be engaged with the inner plate 304.

Subsequently, a releasing mechanism for releasing the holding of the remaining amount indicating lever 325 by the remaining amount indication holding mechanism 325A is described below. A remaining amount indicating cam 327 is supported for sliding along a shaft 328*d* in the directions indicated by the arrows E and F in a state close to the remaining amount indicating lever 325 by the remaining amount indication holder 328. This remaining amount indicating cam 327 is provided with a remaining amount indication click spring 329 which is an urging member pushed along the shaft 328*d* by the remaining amount indicating cam 327 to press a side of the remaining amount indicating lever 325 by a resilient force when the remaining amount indicating cam 327 slides in the direction indicated by the arrow F.

Figure 16:
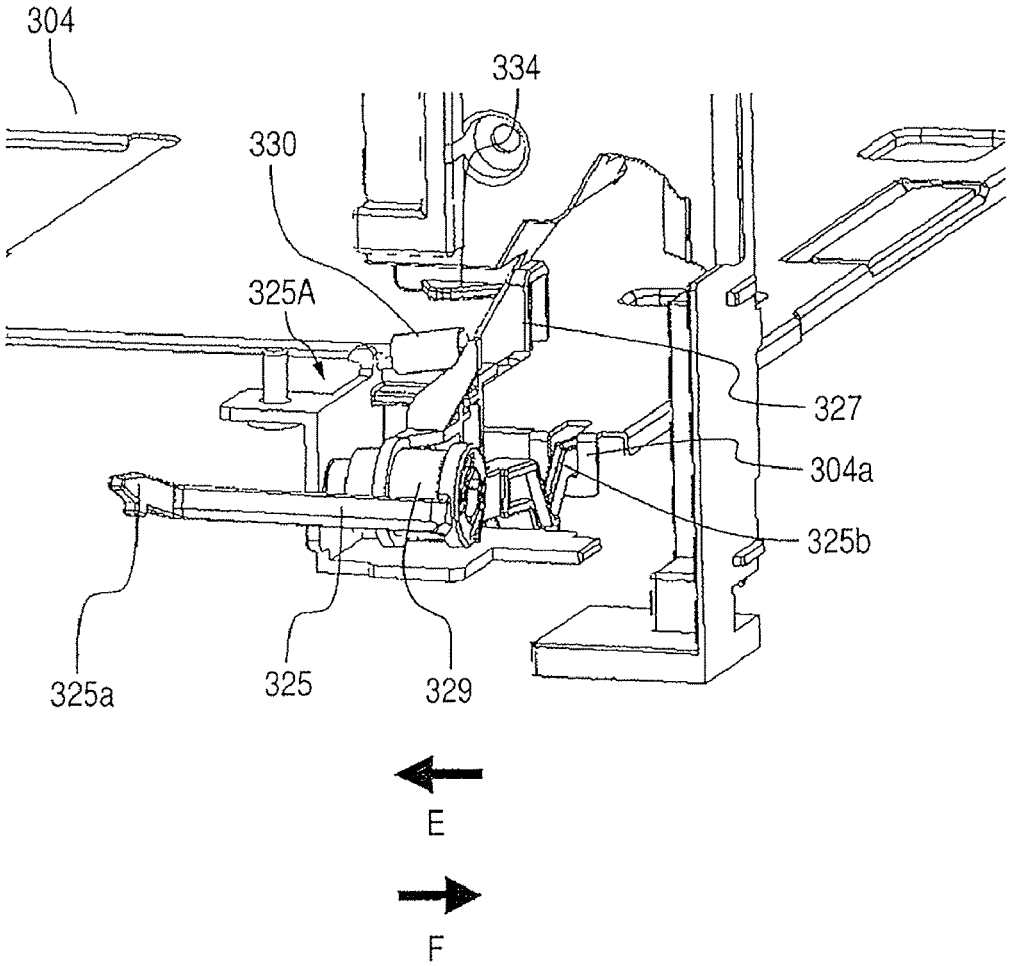
FIG. 16 shows a state in which the sheet feeding cassette of the remaining amount indication holding mechanism has been inserted into the apparatus main body.

Here, this remaining amount indicating cam 327, when the sheet feeding cassette 302 is inserted into the apparatus main body 1, is pressed by a pushing-in rib 334 provided in the apparatus main body 1 as shown in FIG. 16, and slides in the direction indicated by the arrow F. Design is made such that when it thus slides in the direction indicated by the arrow F, a force pulling it in the direction indicated by the arrow E opposite to the sliding direction in FIGS. 15 and 16 is applied to the remaining amount indicating cam 327 by a remaining amount indicating cam spring 330.

That is, when the sheet feeding cassette 302 is inserted into the apparatus main body 1, the remaining amount indicating cam 327 slides in the direction indicated by the arrow F against the remaining amount indicating cam spring 330, and when the sheet feeding cassette 302 is pulled out, the remaining amount indicating cam 327 slides in the direction indicated by the arrow E by the resilient force of the remaining amount indicating cam spring 330.

When the remaining amount indicating cam 327 thus slides, the remaining amount indication click spring 329 moved integrally with the remaining amount indicating cam 327 presses a side of the remaining amount indicating lever 325. Thereby, the remaining amount indicating lever 325 is urged against a stopper portion 328*e* provided on the shaft 328*d* so as to disable the swing of the remaining amount indicating lever 325 by operation of gravity.

The cassette inner plate 304 is in a downwardly moved state when the sheet feeding cassette 302 is inserted into the apparatus main body 1. Here, when the sheet feeding cassette 302 is inserted into the apparatus main body 1, the pressure lever 316 is pivotally moved by the already described mechanism for pivotally moving the pressure lever 316, and along therewith, the cassette inner plate 304 is upwardly pivotally moved so as to bring the stacked sheets into pressure contact with the feed roller 303. Here, in the present embodiment, the urging force (spring force) of the remaining amount indication click spring 329 assumes a magnitude at which the movement of the remaining amount indicating lever 325 accompanying the lift of the cassette inner plate 304 is possible when the cassette inner plate 304 is lifted.

Accordingly, when the cassette inner plate 304 is thus upwardly pivotally moved, even in a state in which the remaining amount indication click spring 329 is in pressure contact, the remaining amount indicating lever 325 slips between it and a stopper portion 328*e* provided on the shaft 328*d*, whereby it swings in operative association with the cassette inner plate 304. Thereby, the remaining amount indicating lever 325 is moved to the height position of the cassette inner plate 304, i.e., a position conforming to the amount of sheets stacked on the cassette inner plate 304.

Thereafter, the image forming operation is started and along therewith, the sheets stacked on the sheet feeding cassette 302 are successively fed whereupon the cassette inner plate 304 is sequentially lifted to a position in which the sheet can be fed, and along therewith, the remaining amount indicating lever 325 also swings.

By the remaining amount indicating lever 325 thus swinging, as shown in FIG. 4, the pointer 325*a* of the remaining amount indicating lever 325 seen from the indication window 326*b* of the sheet feeding cassette cover 326 moves downwardly. Thereby, the user can confirm the remaining amount of sheets from the outside of the sheet feeding cassette 302.

Figure 17:
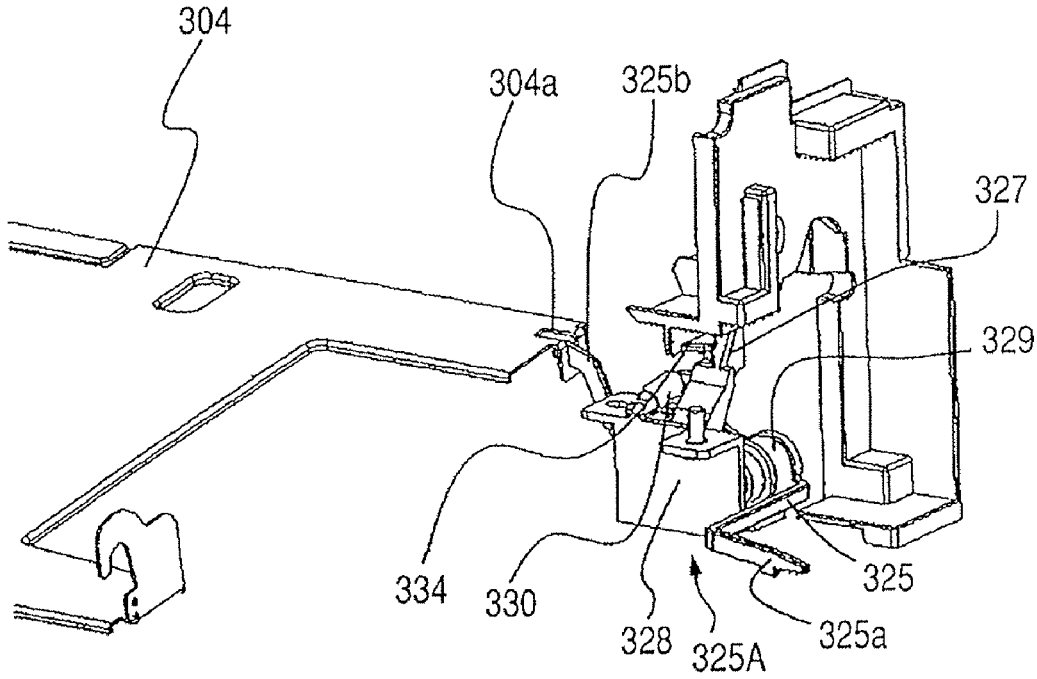
FIG. 17 shows a state in which the cassette inner plate of the remaining amount indication holding mechanism has been lifted.

Now, in the present embodiment, as already described, when there is not the feeding start signal within a predetermined time after the completion of the feeding operation, a signal for reversely driving the pressure motor 110 is transmitted from the main body control portion 6. Thereby, the cassette inner plate 304 is moved (lowered) from a position indicated in FIG. 17 to a position indicated in FIG. 18.

Figure 18:
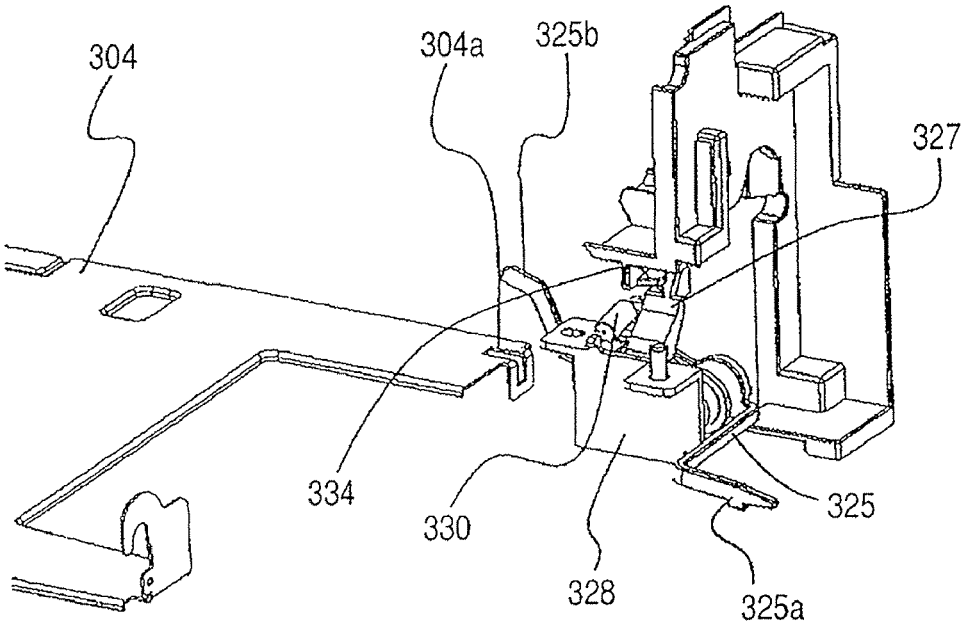
FIG. 18 shows a state in which the cassette inner plate of the remaining amount indication holding mechanism has been lowered.

However, even if the cassette inner plate 304 is thus moved, the remaining amount indicating lever 325 is urged against the stopper portion 328*e* by the remaining amount indication click spring 329 and therefore does not swing. As the result, the remaining amount indicating lever 325, as shown in FIG. 18, is stopped at a position corresponding to the position of the cassette inner plate 304 during the completion of the sheet feeding operation, i.e., before the lowering. Thereby, the user can confirm the correct remaining amount of sheets in the sheet feeding cassette 302 even if the cassette inner plate 304 is lowered after the completion of the sheet feeding operation.

When the sheet feeding cassette 302 is pulled out from the apparatus main body 1, the remaining amount indicating cam 327 is moved in the direction indicated by the arrow E in FIGS. 15 and 16 by the pulling force of the remaining amount indicating cam spring 330, and along therewith, the remaining amount indication click spring 329 also slides in the direction indicated by the arrow E.

When the remaining amount indication click spring 329 thus slides, the urge against the stopper portion 328*e* by the remaining amount indication click spring 329 becomes null and the remaining amount indicating lever 325 swings with the aid of the gravitational force of the lever 325. As the result, the state shown in FIG. 18 wherein the swinging by the remaining amount indication click spring 329 is limited is released, and the remaining amount indicating lever 325 is returned to its initial state in which the other end portion 325*b* thereof enters the groove 304*a* of the lowered cassette inner plate 304.

As described above, when the cassette inner plate 304 is to be lowered, the remaining amount indicating lever 325 moved in association with the lift of the cassette inner plate 304 to indicate the remaining amount of sheets can be held at the position before the cassette inner plate 304 is lowered. Thereby, the remaining amount of sheets can be indicated accurately.

Now, in the present embodiment, when the sheet feeding cassette 302 is pushed into its regular position after the feed roller 303 has come into contact with the separating roller 305 when the sheet feeding cassette 302 is mounted, sliding resistance occurs. Further, much resistance such as the positioning resistance of the sheet feeding cassette 302 and the pressure resistance of a sensor switch for detecting the sheet size occurs immediately before the predetermined containing position of the sheet feeding cassette 302.

So, the sheet feeding apparatus 3 according to the present embodiment has a pulling-in mechanism for the sheet feeding cassette 302 for the purpose of improving the operability of the sheet feeding cassette 302.

Figure 19:
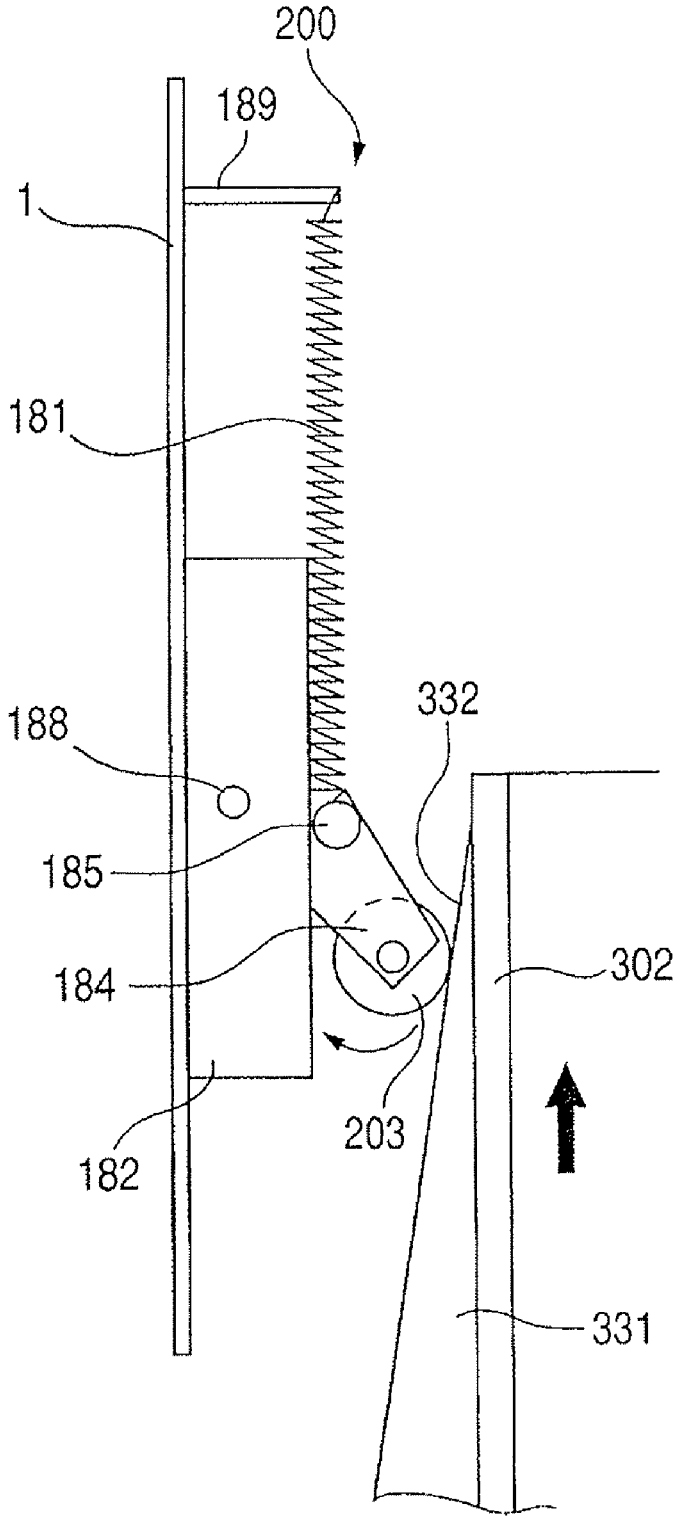
FIG. 19 illustrates the construction of a cassette pulling-in mechanism provided in the sheet feeding apparatus.

FIG. 19 illustrates the construction of such a cassette pulling-in mechanism, and in FIG. 19, the reference numeral 200 designates the cassette pulling-in mechanism. This cassette pulling-in mechanism 200 is provided with a base 182 mounted on the apparatus main body 1, an arm 184 pivotally moved with a shaft 188 provided on the base 182 as a fulcrum, and a runner 183 rotatably held on the pivotal movement end of the arm 184. Also, it is constituted by a resilient member 181 having one end thereof provided on the arm 184 and having the other end thereof restrained on a rib 189 projectedly provided on the apparatus main body 1, and a cam 331 mounted on the sheet feeding cassette 302 shown in FIG. 20. The arm 184, when the sheet feeding cassette 302 is outside the apparatus main body, is urged by the resilient member 181, and contacts with a stopper (not shown) and stands by at a predetermined point.

When the sheet feeding cassette 302 is inserted in a direction orthogonal to the sheet feeding direction indicated by the arrow in FIG. 19, the distal end portion 332 of the cam first contacts with the runner 183. When thereafter the sheet feeding cassette 302 is further inserted, the runner 183 is urged against the cam surface 332 of the cam 331 of the sheet feeding cassette 302 by the resilient member 181, whereby the arm 184 is pivotally moved in the direction indicated by the arrow while rotating the runner 183. At this time, the runner 183 produces a force, which presses the cam 331.

Figure 21:
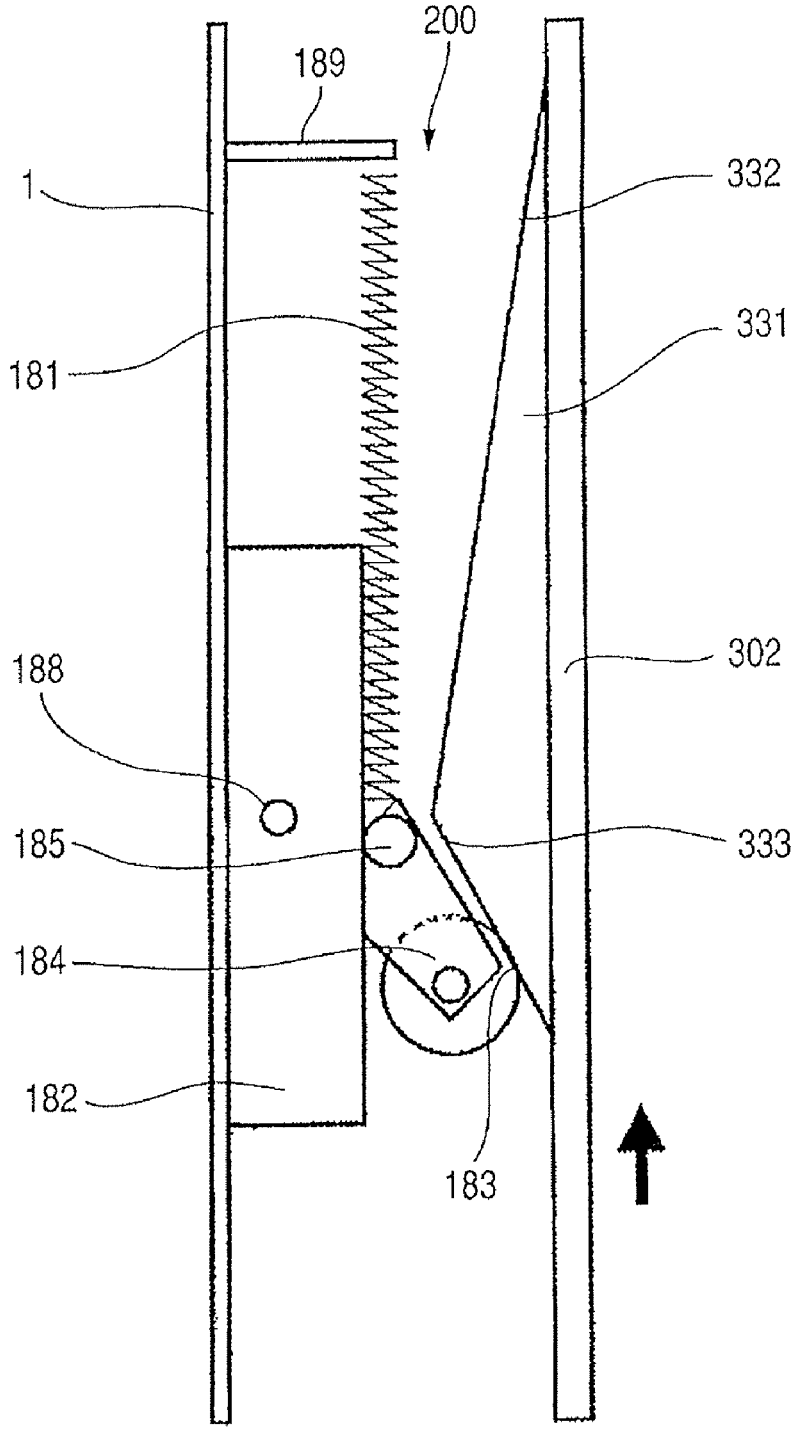
FIG. 21 illustrates the operation of the cassette pulling-in mechanism.

Thereafter, the sheet feeding cassette 302 is further inserted and as shown in FIG. 21, the runner 183 passes the vertex 333 of the cam, whereupon the runner 183 presses the cam 331 in a direction indicated by the arrow in which the sheet feeding cassette 302 is pulled into a regular position in the apparatus main body 1. Thereby, the sheet feeding cassette 302 can be pulled into the apparatus main body 1 by a simple construction and without requiring a great operating force. There is adopted a construction in which the shaft 188 and shaft 185 of the arm 184 on the base 182 are disposed so that a maximum pulling-in pressure force can be produced in the state immediately after the runner has passed the vertex 333 of the cam, to pull in the sheet feeding cassette 302.

However, this cassette pulling-in mechanism 200 is provided on one side of the sheet feeding cassette 302 to make the apparatus main body 1 small. Therefore, when the pulling-in force by the cassette pulling-in mechanism 200 is produced when the sheet feeding cassette 302 is inserted, there is produced a force which inclines the sheet feeding cassette 302 in the direction indicated by the arrow H in FIG. 20.

When such a force in the direction indicated by the arrow H is produced, there is a case where much resistance such as the positioning resistance of the sheet feeding cassette 302 and the pressure resistance of the sensor switch for detecting the sheet size becomes greater than set and the insertion of the sheet feeding cassette 302 into the apparatus main body 1 does not become smooth.

Figure 20:
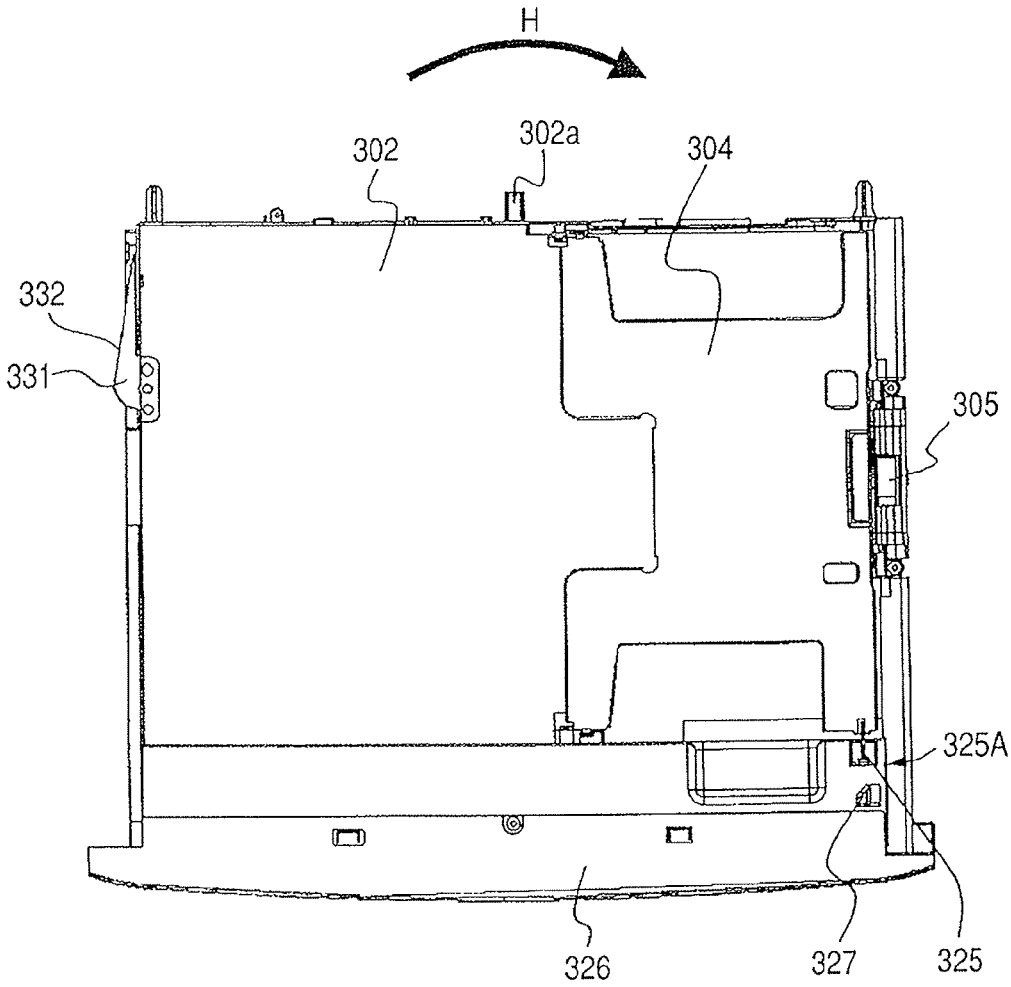
FIG. 20 is a top plan view of the sheet feeding cassette.

So, in the present embodiment, as shown in FIG. 20, a remaining amount indication holding mechanism 325A is provided on a side opposite to the side on which the cam 331 (cassette pulling-in mechanism 200) is disposed. That is, the remaining amount indication holding mechanism 325A is provided at a position opposed to the cassette pulling-in mechanism 200 with respect to the sheet feeding cassette inserting direction.

Thereby, when the sheet feeding cassette 302 is inserted into the apparatus main body 1, as shown in FIG. 16 already described, the remaining amount indicating cam 327 abuts against a pushing-in rib 334, whereby a force is produced in a direction opposite to the direction indicated by the arrow H in FIG. 20.

By such a force being produced in the direction opposite to the direction indicated by the arrow H, the insertion resistance of the sheet feeding cassette 302 can be prevented from becoming great. Further, the pulling-in force of the cassette pulling-in mechanism 200 becomes to accurately work on the sheet feeding cassette 302, and the sheet feeding cassette 302 can smoothly be pulled in.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-027792, filed Feb. 3, 2006, which is hereby incorporated by reference herein in its entirety.

What is claimed is:

1. A sheet feeding apparatus comprising:

a sheet containing portion having a sheet stacking portion movable up and down with sheets stacked thereon;

a sheet feeding portion brought into pressure contact with the stacked sheets by an upward movement of the sheet stacking portion to feed out the sheets;

a lifting and lowering mechanism configured to lift and lower the sheet stacking portion;

a movable remaining amount indicating member which is engaged with the sheet stacking portion so as to indicate the remaining amount of sheets according to a position of the sheet stacking portion, wherein the remaining amount indicating member has a pointer that is moved according to the movement of the sheet stacking portion and indicates to a position outside the sheet containing portion the remaining amount of the sheets in the sheet containing portion; and a holding mechanism configured to hold the remaining amount indicating member by an urging member urging the remaining amount indicating member against a stopper portion, wherein during a lifting operation of the sheet stacking portion by the lifting and lowering mechanism, the holding mechanism enables the remaining amount indicating member to indicate the remaining amount of sheets according to a position of the sheet stacking portion by the lifting operation of the lifting and lowering mechanism; and during a lowering operation of the sheet stacking portion by the lifting and lowering mechanism, following the lifting operation, the holding mechanism holds and maintains the remaining amount indicating member at the position indicated from the lifting operation of the sheet stacking portion.

2. A sheet feeding apparatus according to claim 1, wherein an urging force of the urging member is set to a magnitude at which the remaining amount indicating member can be moved in association with the upward movement of the sheet stacking portion when the sheet stacking portion is moved up.

3. A sheet feeding apparatus according to claim 2, wherein the holding mechanism is provided with a shaft for pivotally supporting the remaining amount indicating member, and the stopper portion provided on the shaft.

4. A sheet feeding apparatus according to claim 3, wherein one end of the remaining amount indicating member is engaged with the sheet stacking portion and the pointer is provided at the other end of the remaining amount indicating member.

5. A sheet feeding apparatus according to claim 2, wherein the urging force of the urging member is applied to the remaining amount indicating member in a state in which the sheet containing portion is mounted on the main body of the apparatus, and the sheet feeding apparatus comprises a releasing mechanism configured to release the urging force of the urging member when the sheet containing portion has been taken out of the apparatus main body.

6. A sheet feeding apparatus according to claim 5, wherein the holding mechanism is provided with a shaft for pivotally supporting the remaining amount indicating member, and the stopper portion provided on the shaft, and can hold the remaining amount indicating member by the urging member urging the remaining amount indicating member against the stopper portion, and the releasing mechanism has a remaining amount indicating cam slidably disposed on the shaft, and slidingly moves the remaining amount indicating cam so as to release the urging force of the urging member according to an operation of pulling out the sheet containing portion from the apparatus main body.

7. An image forming apparatus provided with an image forming portion for forming an image on a sheet fed out from a sheet feeding apparatus, the image forming apparatus comprising:

a sheet containing portion having a sheet stacking portion movable up and down with sheets stacked thereon;

a sheet feeding portion brought into pressure contact with the stacked sheets by the upward movement of the sheet stacking portion to feed out the sheets;

a lifting and lowering mechanism configured to lift and lower the sheet stacking portion;

a movable remaining amount indicating member which is engaged with the sheet stacking portion so as to indicate the remaining amount of sheets according to a position of the sheet stacking portion, wherein the remaining amount indicating member has a pointer that is moved according to the movement of the sheet stacking portion and indicates to a position outside of the sheet containing portion the remaining amount of the sheets in the sheet containing portion; and a holding mechanism configured to hold the remaining amount indicating member by an urging member urging the remaining amount indicating member against a stopper portion, wherein during a lifting operation of the sheet stacking portion by the lifting and lowering mechanism, the holding mechanism enables the remaining amount indicating member to indicate the remaining amount of sheets according to a position of the sheet stacking portion by the lifting operation of the lifting and lowering mechanism; and during a lowering operation of the sheet stacking portion by the lifting and lowering mechanism, following the lifting operation, the holding mechanism holds and maintains the remaining amount indicating member at the position indicated from the lifting operation of the sheet stacking portion.

8. An image forming apparatus according to claim 7, wherein an urging force of the urging member is set to a magnitude at which the remaining amount indicating member can be moved in association with the upward movement of the sheet stacking portion when the sheet stacking portion is moved up.

9. An image forming apparatus according to claim 8, wherein the holding mechanism is provided with a shaft for pivotally supporting the remaining amount indicating member, and the stopper portion provided on the shaft.

10. An image forming apparatus according to claim 9, wherein one end of the remaining amount indicating member is engaged with the sheet stacking portion and the pointer is provided at the other end of the remaining amount indicating member.

11. An image forming apparatus according to claim 8, wherein the urging force of the urging member is applied to the remaining amount indicating member in a state in which the sheet containing portion is mounted on the main body of the apparatus, and the sheet feeding apparatus comprises a releasing mechanism configured to release the urging force of the urging member when the sheet containing portion has been taken out of the apparatus main body.

12. An image forming apparatus according to claim 11, wherein the holding mechanism is provided with a shaft for pivotally supporting the remaining amount indicating member, and the stopper portion provided on the shaft, and can hold the remaining amount indicating member by the urging member urging the remaining amount indicating member against the stopper portion, and the releasing mechanism has a remaining amount indicating cam slidably disposed on the shaft, and slidingly moves the remaining amount indicating cam so as to release the urging force of the urging member according to an operation of pulling out the sheet containing portion from the apparatus main body.

* * * * *